US010570549B2

(12) United States Patent
Kim et al.

(10) Patent No.: US 10,570,549 B2
(45) Date of Patent: Feb. 25, 2020

(54) WASHING MACHINE AND CONTROL METHOD OF THE SAME

(71) Applicant: Samsung Electronics Co., Ltd, Gyeonggi-do (KR)

(72) Inventors: Tae-kil Kim, Suwon-si (KR); Jong-woon Park, Hwaseong-si (KR); Sung-mo Lee, Gunpo-si (KR); Young-jin Hong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 167 days.

(21) Appl. No.: 15/441,010

(22) Filed: Feb. 23, 2017

(65) Prior Publication Data

US 2017/0241063 A1 Aug. 24, 2017

(30) Foreign Application Priority Data

Feb. 23, 2016 (KR) ..... 10-2016-0021480

(51) Int. Cl.

| | |
|---|---|
| ***D06F 37/30*** | (2006.01) |
| *D06F 23/04* | (2006.01) |
| *D06F 33/02* | (2006.01) |

(52) U.S. Cl.

CPC ..... *D06F 37/304* (2013.01); *D06F 23/04* (2013.01); *D06F 33/02* (2013.01); *D06F 2220/00* (2013.01)

(58) Field of Classification Search

None

See application file for complete search history.

(56) References Cited

U.S. PATENT DOCUMENTS

| | | | | |
|---|---|---|---|---|
| 7,543,464 | B2 * | 6/2009 | Choi | D06F 37/40 68/12.24 |
| 2003/0177794 | A1 * | 9/2003 | Yoon | D06F 37/40 68/12.01 |
| 2008/0042510 | A1 * | 2/2008 | Park | D06F 37/304 310/216.004 |

FOREIGN PATENT DOCUMENTS

KR 10-0519330 B1 6/2004

* cited by examiner

*Primary Examiner* — Cristi J Tate-Sims

(57) ABSTRACT

A washing machine includes a main body; a washing tub provided inside the main body to receive washing water; a dewatering tub rotatably provided inside the washing tub; a driving device configured to supply a rotational force; a clutch unit to operate in a first mode in which the rotational force generated in the driving device is transmitted to the dewatering tub and a second mode in which the rotational force is not transmitted to the dewatering tub; a clutch motor to switch an operation mode of the clutch unit; and a cam switch switched from a switch-off state to a switch-on state, wherein the cam switch outputs pulses having the same period as a frequency of AC power supplied to the clutch motor in the switch-on state, and when the cam switch is switched from the switch-off state to the switch-on state, the clutch unit is stopped.

9 Claims, 22 Drawing Sheets

WASHING MACHINE AND CONTROL METHOD OF THE SAME

CROSS-REFERENCE TO RELATED APPLICATION(S) AND CLAIM OF PRIORITY

This application claims priority from Korean Patent Application No. 10-2016-0021480 filed Feb. 23, 2016 in the Korean Intellectual Property Office, the disclosure of which is incorporated herein by reference in its entirety.

BACKGROUND

1. Field

The present disclosure relates to a washing machine. More particularly, the present disclosure relates to arrangement of a clutch unit and a cam switch of a washing machine that can selectively transmit power to a washing shaft and a dewatering shaft, and a control method of the washing machine.

2. Description of the Related Art

A washing machine is a machine for washing clothing using electric power, and is largely classified into a drum washing machine and an automatic washing machine.

Generally, the automatic washing machine includes a washing tub for receiving washing water, a dewatering tub rotatably disposed inside the washing tub, a pulsator rotatably disposed on the bottom of the dewatering tub, a driving device for rotating the dewatering tub and the pulsator, and a clutch unit for selectively transmitting power to the dewatering tub.

When the dewatering tub and the pulsator rotate while laundry and detergent water are introduced into the dewatering tub, the pulsator stirs the laundry introduced into the dewatering tub together with the washing water to remove the impurities from the laundry.

The pulsator is directly connected to the driving device and is always rotated when the driving device is operated. However, the dewatering tub is selectively rotated by the clutch unit connected to a dewatering shaft. Therefore, when a washing mode is performed, the rotation of the dewatering shaft is prevented by the clutch unit so that only the pulsator is rotated, and when a dewatering mode is performed, the dewatering shaft is rotated by the clutch unit so that the dewatering tub is rotated together with the pulsator.

In general, the clutch unit is configured such that the dewatering shaft is rotated or prevented from rotating through a coupling that is vertically moved by a clutch motor.

A configuration for switching between the washing mode and the dewatering mode using the clutch motor is disclosed in Korean Patent Publication No. 10-2004-0046064 (title of invention: method of switching power transmission mode of washing machine, publication date: 2004 Jun. 5).

The conventional washing machine for switching between the washing mode and the dewatering mode uses a method of stopping the clutch motor after driving the clutch motor for a predetermined time when a contact signal of the clutch motor is detected. At this time, the predetermined time is determined by calculating the time required for rotating a cam rotated by the clutch motor by a predetermined angle in consideration of the rotational speed of the clutch motor under the rated voltage and frequency conditions. On the other hand, the predetermined time may be measured by a method of measuring the time using an internal clock or a method of measuring the number of pulses of electricity flowing through the contact point.

However, the rotational speed of the clutch motor when the rated voltage and frequency are not applied to the washing machine is different from the rotational speed of the clutch motor when the rated voltage and frequency are applied. Accordingly, when the rated voltage and frequency are not applied to the washing machine, the stop position of the cam is different from the design stop position even if the clutch motor stops after the predetermined time.

Further, in the method of measuring the number of pulses, when the rated voltage and frequency are not applied to the washing machine, the number of pulses varies accordingly. Therefore, when the clutch motor stops after the predetermined time, the cam may stop at the design stop position. However, in a region where the power supply environment is poor, a noise component may occur in the power supply frequency. In this case, an error occurs in the number of pulses measured so that the stop position of the cam becomes different from the design stop position.

When the cam rotated by the clutch motor does not come to the design stop position, the coupling change of the clutch unit is incomplete so that the coupling may be damaged.

SUMMARY

Additional aspects and/or advantages will be set forth in part in the description which follows and, in part, will be apparent from the description, or may be learned by practice of the disclosure.

The present disclosure has been developed in order to overcome the above drawbacks and other problems associated with the conventional arrangement. An aspect of the present disclosure relates to a washing machine that can prevent a coupling of a clutch unit from being damaged by allowing a cam to be positioned at a design stop position even in a poor power supply environment, and a control method of the washing machine.

According to an aspect of the present disclosure, a washing machine may include a main body; a washing tub provided inside the main body to receive washing water; a dewatering tub rotatably provided inside the washing tub; a driving device configured to supply a rotational force; a clutch unit provided to operate in a first mode in which the rotational force generated in the driving device is transmitted to the dewatering tub and a second mode in which the rotational force generated in the driving device is not transmitted to the dewatering tub; a clutch motor to switch an operation mode of the clutch unit; and a cam switch switched from a switch-off state to a switch-on state as the clutch motor rotates, wherein the cam switch outputs pulses having the same period as a frequency of an alternative current power supplied to the clutch motor in the switch-on state, and wherein when the cam switch is switched from the switch-off state to the switch-on state, the clutch unit is stopped.

The washing machine may include a pulsator rotatably provided in a bottom of the dewatering tub, wherein when the clutch unit operates in the first mode, the dewatering tub and the pulsator rotate together, and when the clutch unit operates in the second mode, the pulsator rotates.

According to another aspect of the present disclosure, a control method of a washing machine which comprises a dewatering tub, a driving device to supply a rotational force, a clutch unit to operate in a first mode in which the rotational force generated in the driving device is transmitted to the dewatering tub and a second mode in which the rotational force generated in the driving device is not transmitted to the dewatering tub, a clutch motor to switch an operation mode of the clutch unit, and a cam switch that is switched from a switch-off state to a switch-on state as the clutch motor rotates and outputs pulses having the same period as a frequency of an alternative current power supplied to the clutch motor in the switch-on state, the control method may include driving the clutch motor; determining whether a predetermined first time has elapsed without a pulse being input from the cam switch; counting a number of pulses input from the cam switch after the first time has elapsed; and stopping the driving of the clutch motor when it is determined that a predetermined second time has elapsed since an Nth pulse was input.

The control method may include determining whether an elapsed time until the Nth pulse is input since the counting the pulses input from the cam switch is within a predetermined third time.

The control method may include counting pulses input after the predetermined third time elapses when it is determined that the predetermined third time has elapsed before the Nth pulse is input since the counting the pulses input from the cam switch.

According to another aspect of the present disclosure, a control method of a washing machine which comprises a dewatering tub, a driving device to supply a rotational force, a clutch unit to operate in a first mode in which the rotational force generated in the driving device is transmitted to the dewatering tub and a second mode in which the rotational force generated in the driving device is not transmitted to the dewatering tub, a clutch motor to switch an operation mode of the clutch unit, and a cam switch that is switched from a switch-off state to a switch-on state as the clutch motor rotates and outputs pulses having the same period as a frequency of an alternative current power supplied to the clutch motor in the switch-on state, the control method may include driving the clutch motor; counting pulses input from the cam switch; determining whether a predetermined first time has elapsed in a state where the pulses are not input from the cam switch; and stopping the driving of the clutch motor when it is determined that a predetermined second time has elapsed after the predetermined first time has elapsed.

Other objects, advantages and salient features of the present disclosure will become apparent from the following detailed description, which, taken in conjunction with the annexed drawings, discloses preferred embodiments.

BRIEF DESCRIPTION OF THE DRAWINGS

These and/or other aspects and advantages of the present disclosure will become apparent and more readily appreciated from the following description of the embodiments, taken in conjunction with the accompanying drawings of which.

Throughout the drawings, like reference numerals will be understood to refer to like parts, components and structures.

DETAILED DESCRIPTION

Hereinafter, certain exemplary embodiments of the present disclosure will be described in detail with reference to the accompanying drawings.

The matters defined herein, such as a detailed construction and elements thereof, are provided to assist in a comprehensive understanding of this description. Thus, it is apparent that exemplary embodiments may be carried out without those defined matters. Also, well-known functions or constructions are omitted to provide a clear and concise description of exemplary embodiments. Further, dimensions of various elements in the accompanying drawings may be arbitrarily increased or decreased for assisting in a comprehensive understanding.

The terms "first", "second", etc. may be used to describe diverse components, but the components are not limited by the terms. The terms are only used to distinguish one component from the others.

The terms used in the present application are only used to describe the exemplary embodiments, but are not intended to limit the scope of the disclosure. The singular expression also includes the plural meaning as long as it does not differently mean in the context. In the present application, the terms "include" and "consist of" designate the presence of features, numbers, steps, operations, components, elements, or a combination thereof that are written in the specification, but do not exclude the presence or possibility of addition of one or more other features, numbers, steps, operations, components, elements, or a combination thereof.

Figure 1:
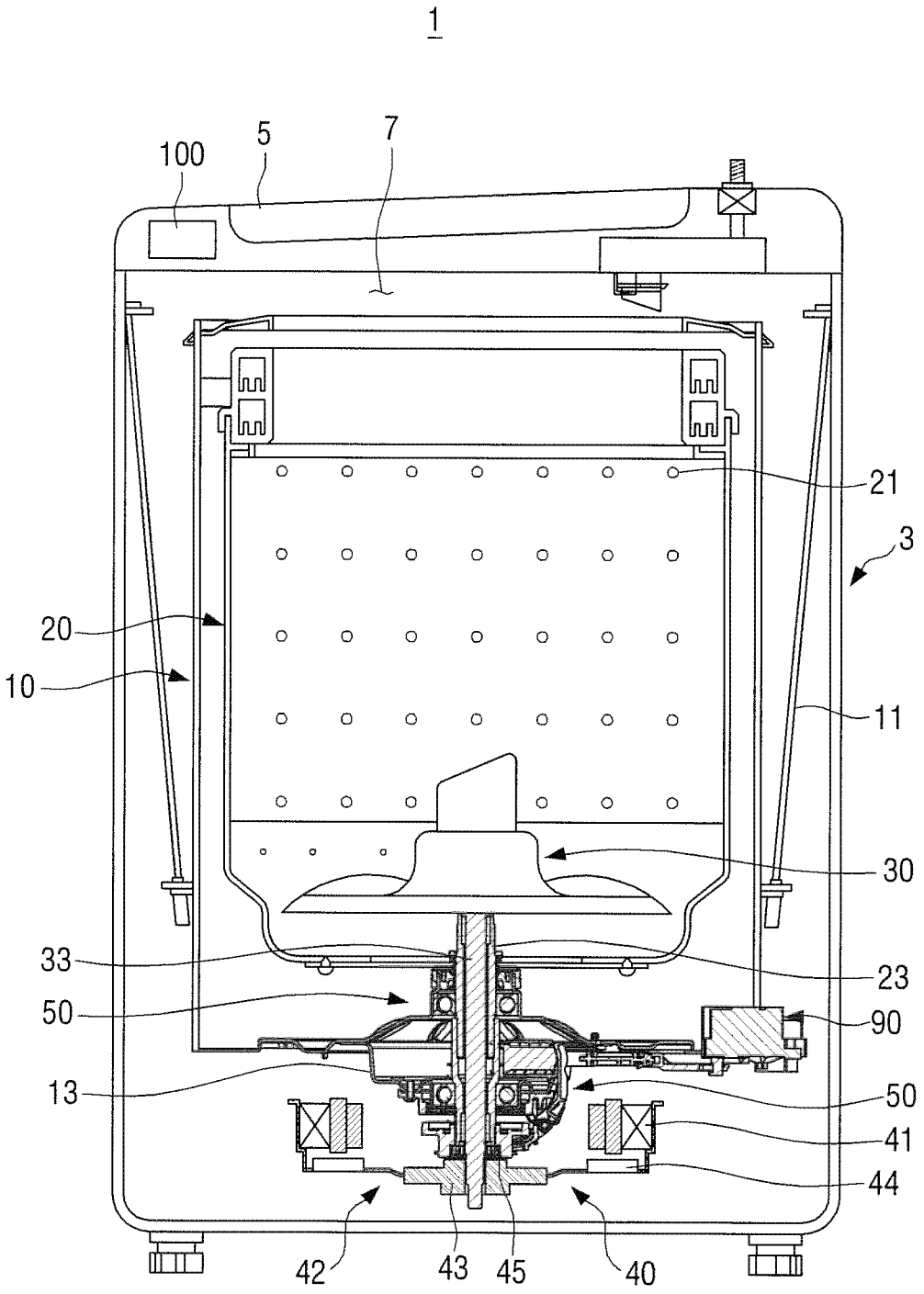
FIG. 1 is a cross-sectional view illustrating a washing machine according to an embodiment of the present disclosure.

FIG. 1 is a cross-sectional view illustrating a washing machine according to an embodiment of the present disclosure.

Referring to FIG. 1, a washing machine 1 according to an embodiment of the present disclosure may include a main body 3, a washing tub 10, a dewatering tub 20, a pulsator 30, a driving device 40, a clutch unit 50, and a clutch motor 90.

The main body 3 forms an appearance of the washing machine 1, and is formed in a substantially rectangular parallelepiped shape. A laundry loading opening 7 is provided at an upper end of the main body 3 so that laundry can be input into the washing tub 10. Also, the upper end of the main body 3 may be provided with a door 5 for opening and closing the laundry loading opening 7.

The washing tub 10 is disposed inside the main body 3, and is formed to receive a predetermined amount of washing water. Also, the washing tub 10 is supported by a suspension 11 with respect to the main body 3 so that vibration generated in the washing tub 10 is attenuated during washing. A housing 13 through which a washing shaft 33 and a dewatering shaft 23 are rotatably passed is provided below the washing tub 10. A rotation preventing gear 15, which is engaged with a coupling 80 of the clutch unit 50 described later to prevent rotation of the coupling 80, is provided in the bottom surface of the housing 13.

The dewatering tub 20 is formed in a substantially hollow cylindrical shape, and is rotatably disposed inside the washing tub 10. A plurality of through holes 21 are provided in the side surface of the dewatering tub 20, so that the washing water of the dewatering tub 20 can flow out to the washing tub 10, and the washing water of the washing tub 10 can enter the dewatering tub 20. The bottom surface of the dewatering tub 20 is coupled with the dewatering shaft 23, so that when the dewatering shaft 23 is rotated, the dewatering tub 20 is rotated integrally with the dewatering shaft 23.

The pulsator 30 is disposed on the bottom of the inside of the dewatering tub 20 so as to be rotatable independently from the dewatering tub 20, and stirs the laundry introduced into the dewatering tub 20 together with the washing water. The pulsator 30 is connected to the driving device 40 by the washing shaft 33. When a rotating force is generated in the driving device 40, the washing shaft 33 is rotated. When the washing shaft 33 is rotated, the pulsator 30 is rotated integrally with the washing shaft 33.

The driving device 40 is provided below the pulsator 30, that is, below the washing tub 10, and generates the rotating force to rotate the pulsator 30 and the dewatering tub 20. The driving device 40 may be implemented as a driving motor. The driving motor 40 may include a stator 41 and a rotor 42 rotatably disposed with respect to the stator 41. The rotor 42 rotates by electromagnetic interaction with the stator 41. In the embodiment as illustrated in FIG. 1, a brushless direct current motor that can control variously a rotational speed is used as the driving motor 40.

The rotor 42 is formed in a substantially circular plate shape, and a permanent magnet 44 is provided on the outer periphery of the circular plate. Accordingly, when power is applied to the stator 41, the rotor 42 rotates. The washing shaft 33 is vertically connected to the rotation center of the circular plate 43 of the rotor 42, so that when the rotor 42 rotates, the washing shaft 33 is rotated integrally with the rotor 42. A power transmission gear 45 that can transmit power to the clutch unit 50 is provided on the upper surface of the circular plate 43 coaxially with the washing shaft 33.

The dewatering shaft 23 is disposed outside the washing shaft 33. In other words, the dewatering shaft 23 is formed in a hollow shaft, and the washing shaft 33 is rotatably disposed inside the dewatering shaft 23. An end of the dewatering shaft 23 is fixed to the bottom surface of the dewatering tub 20, so that when the dewatering shaft 23 rotates, the dewatering tub 20 is rotated integrally with the dewatering shaft 23.

An outer serration 25 is provided on the outer side of the lower end of the dewatering shaft 23, so that the coupling 80 of the clutch unit 50 described later can be linearly moved up and down. The dewatering shaft 23 are supported at opposite ends by bearings 17 provided in the housing 13 of the washing tub 10, so that the dewatering shaft 23 can stably rotate with respect to the housing 13.

The clutch unit 50 may be configured to operate in two modes. For example, the clutch unit 50 may operate in a first mode in which the rotational force generated in the driving device 40 is transmitted to the dewatering tub 20 so that the dewatering tub 20 is rotated, and in a second mode in which the rotational force generated in the driving device 40 is not transmitted to the dewatering tub 20 so that the dewatering tub 20 is not rotated.

In detail, the clutch unit 50 is disposed below the pulsator 30, and is formed to selectively transmit the rotational force generated in the driving device 40 to the dewatering shaft 23. For example, in the first mode in which the dewatering tub 20 rotates, that is, in the dewatering mode, the clutch unit 50 is formed to transmit the rotational force of the driving device 40 to the dewatering shaft 23 so that the dewatering shaft 23 rotates simultaneously with the washing shaft 33 so that the dewatering tub 20 and the pulsator 30 are simultaneously rotated. In the second mode in which the dewatering tub 20 does not rotate, that is, in the washing mode, the clutch unit 50 does not transmit the rotational force of the driving device 40 to the dewatering shaft 23 so that only the washing shaft 33 rotates and the dewatering shaft 23 does not rotate so that the dewatering tub 20 does not rotate. The operation mode of the clutch unit 50 is switched by the clutch motor 90 provided in the one side of the clutch unit 50.

Hereinafter, the clutch unit 50 and the clutch motor 90 used in the washing machine 1 according to an embodiment of the present disclosure will be described in detail with reference to FIGS. 2 to 7.

Figure 2:
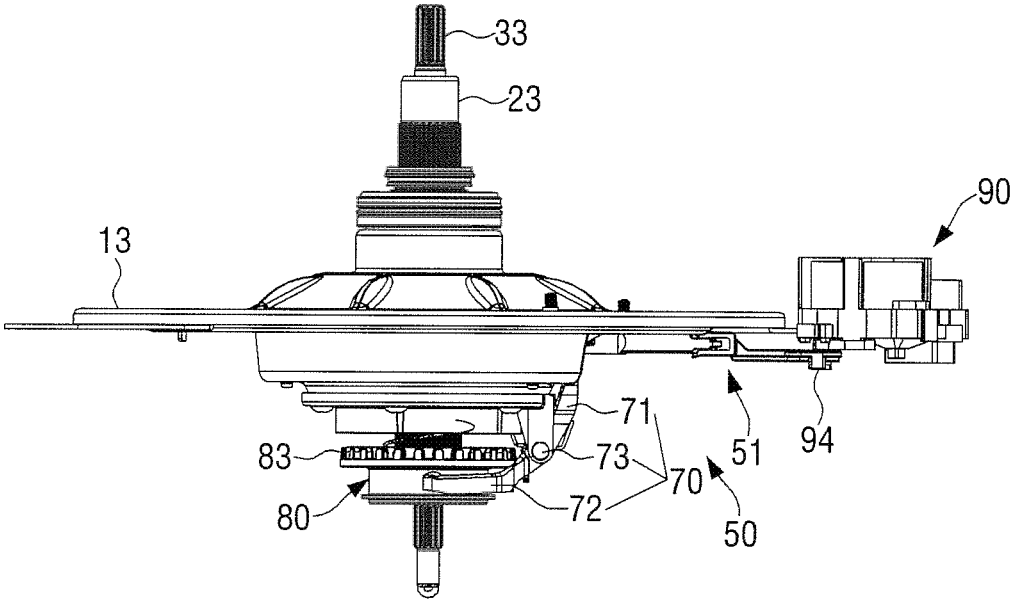
FIG. 2 is a view illustrating a clutch unit of a washing machine according to an embodiment of the present disclosure.
Figure 3:
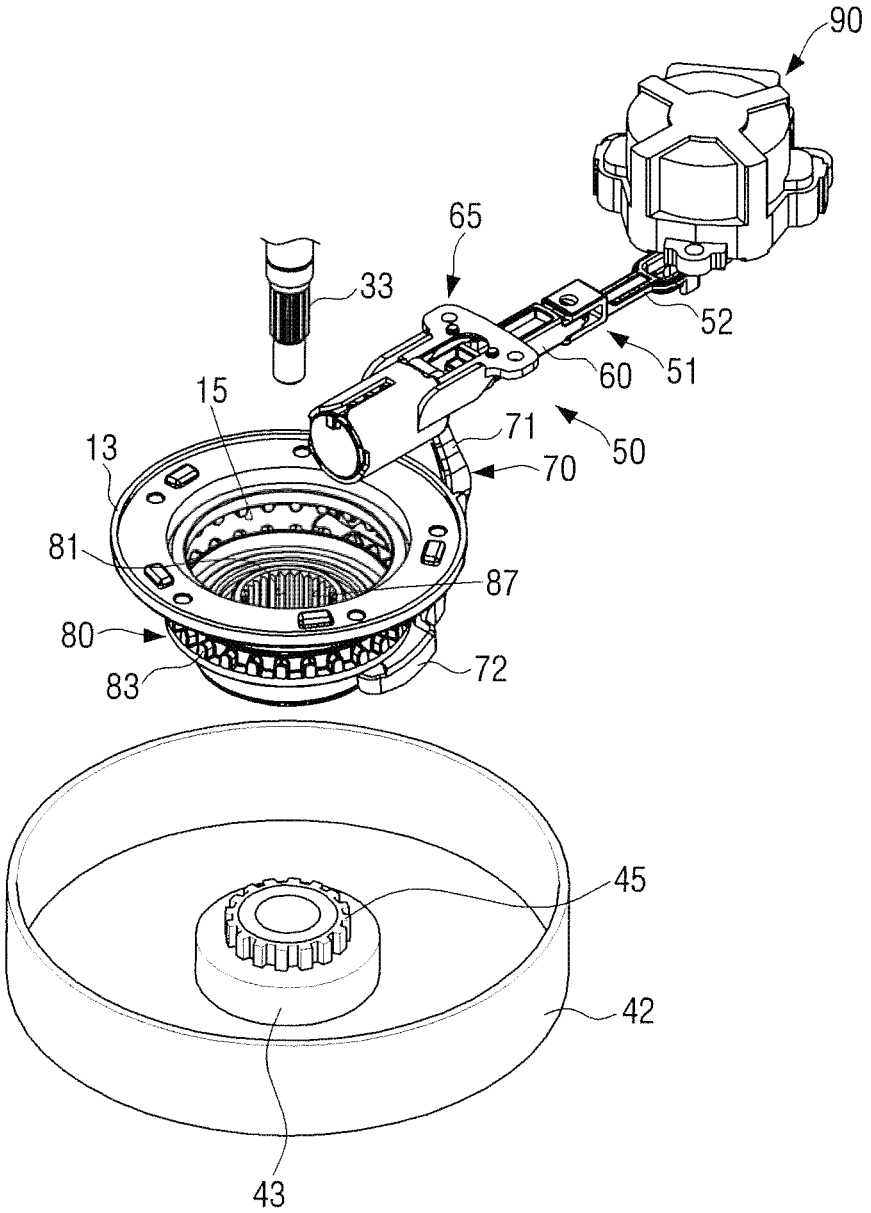
FIG. 3 is a perspective view illustrating a rotor, a clutch unit, and a clutch motor of a washing machine according to an embodiment of the present disclosure.
Figure 4:
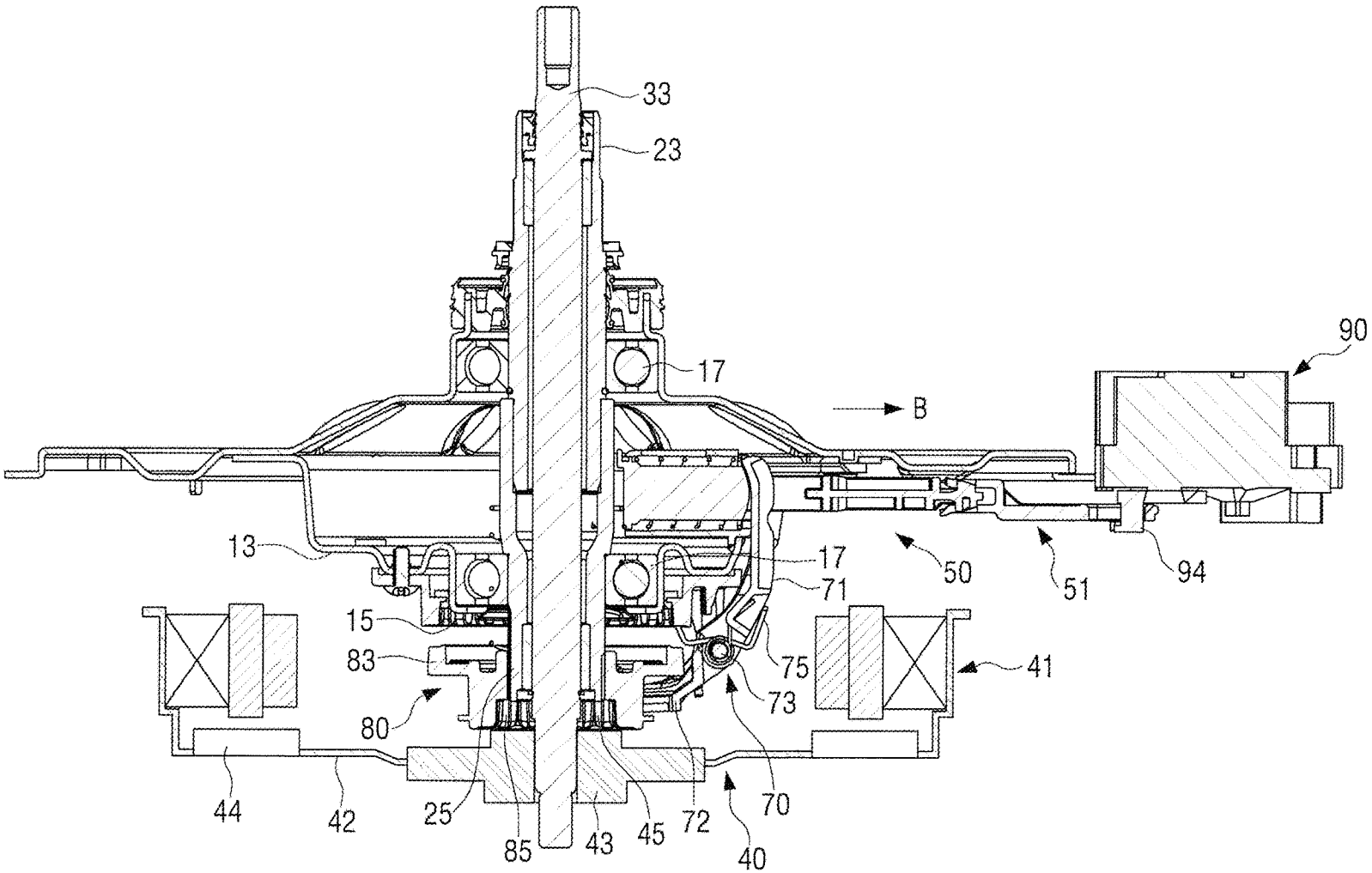
FIG. 4 is a partial cross-sectional view for explaining power transmission of a washing machine according to an embodiment of the present disclosure.
Figure 5:
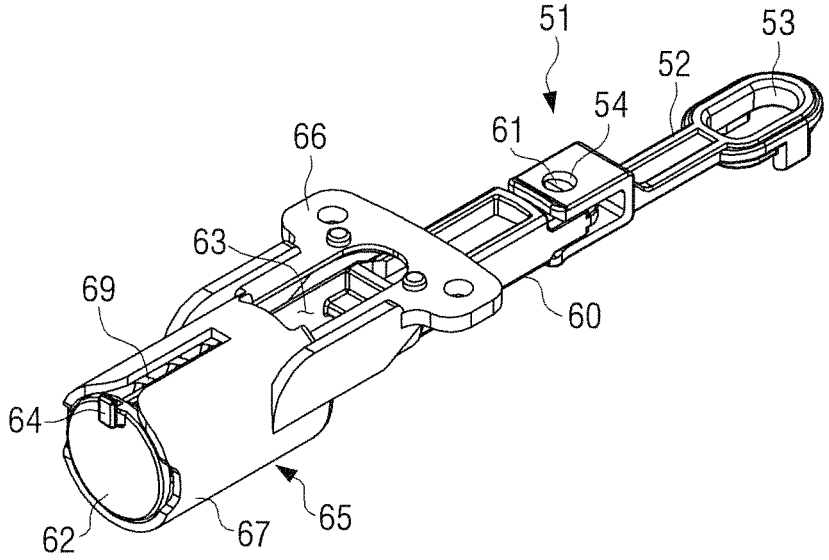
FIG. 5 is a perspective view illustrating a link member of a clutch unit of a washing machine according to an embodiment of the present disclosure.
Figure 6:
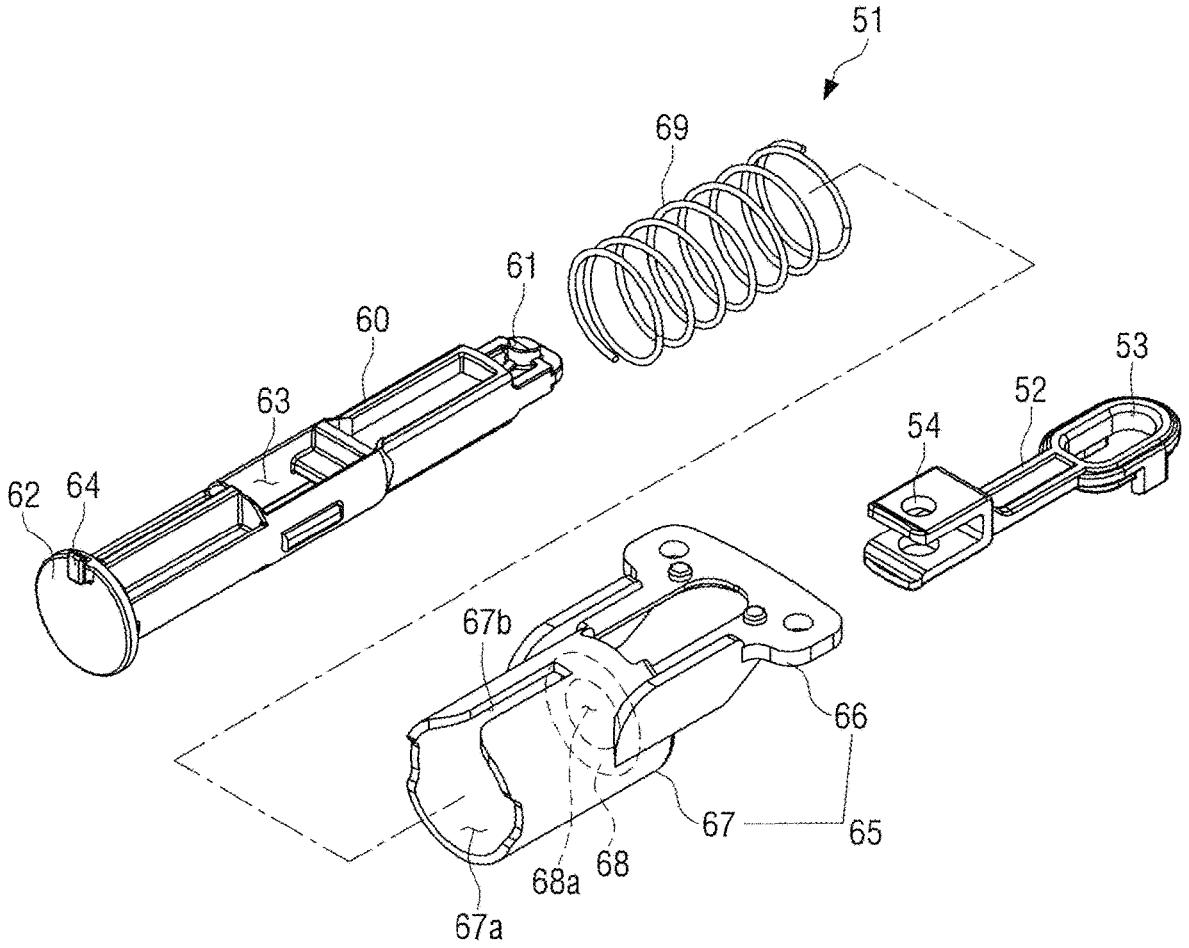
FIG. 6 is an exploded perspective view illustrating a link member of FIG. 5.
Figure 7:
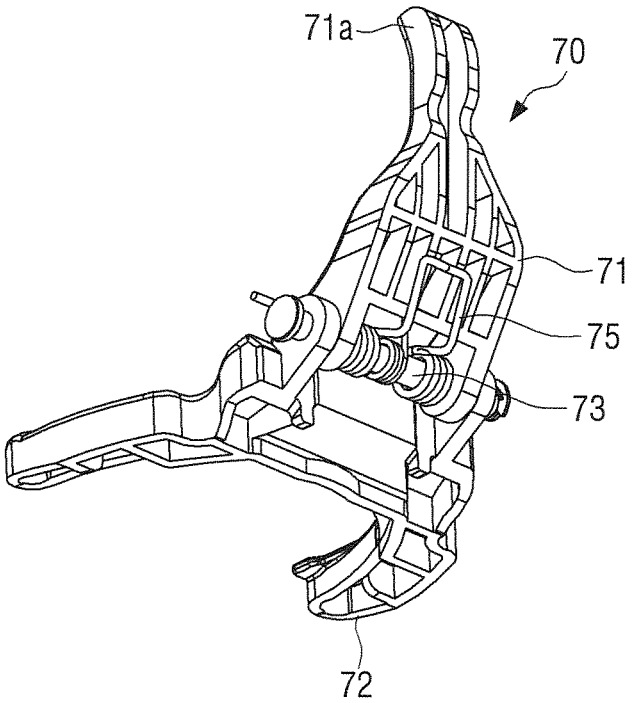
FIG. 7 is a perspective view illustrating a rotating member of a clutch unit of a washing machine according to an embodiment of the present disclosure.

FIG. 2 is a view illustrating a clutch unit of a washing machine according to an embodiment of the present disclosure. FIG. 3 is a perspective view illustrating a rotor, a clutch unit, and a clutch motor of a washing machine according to an embodiment of the present disclosure. FIG. 4 is a partial cross-sectional view for explaining power transmission of a washing machine according to an embodiment of the present disclosure. FIG. 5 is a perspective view illustrating a link member of a clutch unit of a washing machine according to an embodiment of the present disclosure, and FIG. 6 is an exploded perspective view illustrating the link member of FIG. 5. FIG. 7 is a perspective view illustrating a rotating member of a clutch unit of a washing machine according to an embodiment of the present disclosure.

Referring to FIGS. 2 to 7, the clutch unit 50 may include a link member 51, a rotating member 70, and a coupling 80.

The link member 51 is formed to convert the rotational motion of the clutch motor 90 into a linear motion, and to transmit the linear motion to the rotating member 70. In other words, the link member 51 is formed to reciprocate in response to the rotational force of the clutch motor 90, thereby pivotally rotating the rotating member 70. The link member 51 may include a rotating link 52 connected with the clutch motor 90, a link 60 connected to the rotating link 52, a guide 65 for guiding a linear movement of the link 60, and a return spring 69 for elastically supporting the link 60 with respect to the guide 65.

One end of the rotating link 52 is provided with a hook portion 53 connected with a rotational protrusion 94 of the clutch motor 90, and the other end of the rotating link 52 is provided with a hinge hole 54 so that the other end of the rotating link 52 is hingedly connected to one end of the link 60. The hook portion 53 is formed in an elongated hole having a length longer than the diameter of the rotational protrusion 94 of the clutch motor 90. Accordingly, when the clutch motor 90 rotates, the rotational protrusion 94 inserted into the hook portion 53 of the rotating link 52 moves along the elongated hole of the hook portion 53, thereby moving the rotating link 52.

Figure 11:
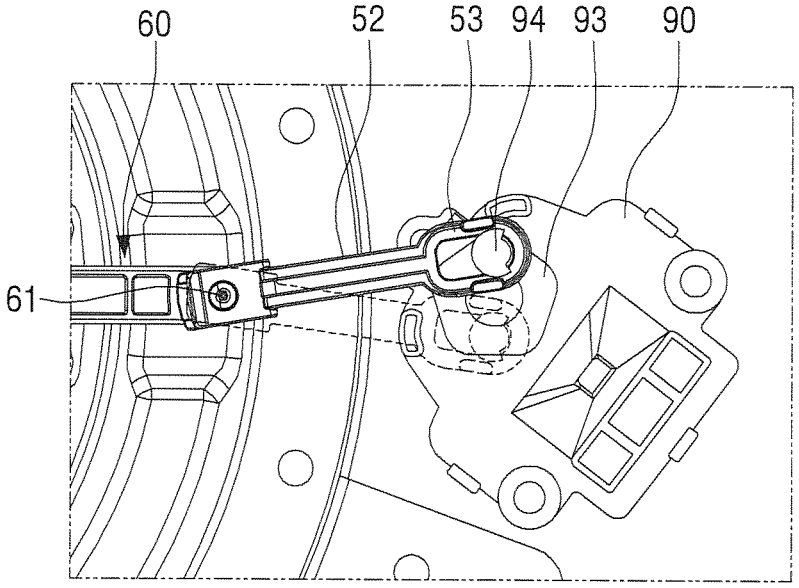
FIG. 11 is a view illustrating a relationship between a clutch motor and a link member when a washing machine according to an embodiment of the present disclosure is between a dewatering mode and a washing mode.

The link 60 is formed to be inserted into the guide 65 and linearly moved with respect to the guide 65, and one end of the link 60 is provided with a hinge shaft 61 inserted into the hinge hole 54 of the rotating link 52 so that the link 60 is hingedly connected with the rotating link 52. Accordingly, when the rotating link 52 is rotated at a predetermined angle on the hinge shaft 61 by the clutch motor 90 as illustrated in FIG. 11, the link 60 is linearly moved along the guide 65. The other end of the link 60 is provided with a support portion 62 to support the return spring 69. An inserting hole 63 into which the one end of the rotating member 70 is inserted is provided at an approximately central portion of the link 60. Accordingly, when the link 60 is linearly moved, the rotating member 70 inserted into the inserting hole 63 is rotated.

The support portion 62 supports one end of the return spring 69 so that when the link 60 linearly moves in the outward direction (a direction of arrow B in FIG. 4) from washing shaft 33, the return spring 69 is compressed. One side of the support portion 62 is provided with a rotation preventing protrusion 64 for preventing the rotation of the link 60 when the link 60 linearly moves.

The guide 65 may include a connecting portion 66 for fixing the guide 65 to the housing 13 and a guiding portion 67 which is formed in a hollow cylindrical shape and guides the linear movement of the link 60. One end of the guiding portion 67 is provided with an opening 67*a* having a diameter larger than that of the support portion 62 so that the link 60 can be inserted into the opening 67*a* and linearly moved, and the other end of the guiding portion 67 is provided with a through-support portion 68 supporting the other end of the return spring 69 and having a through hole 68*a* through which the link 65 can pass.

The through hole 68*a* of the through-support portion 68 has a diameter smaller than that of the support portion 62 of the inserted link 60 so that the support portion 62 cannot pass through the through hole 68*a*. Accordingly, the through-support portion 68 supports the other end of the return spring 69 and restricts the linear motion range of the link 60.

The return spring 69 is disposed inside the guiding portion 67, and the link 60 passes through the inside of the return spring 69. Accordingly, when the link 60 moves in the direction away from the washing shaft 33 (the direction of arrow A), the return spring 69 is compressed, and when the link 60 moves in the direction approaching the washing shaft 33, the return spring 69 is restored to its original state.

The guiding portion 67 is provided with a rotation preventing guide portion 67*b* for preventing rotation while the link 60 is linearly moved. The rotation preventing guide portion 64*b* is formed in a groove shape elongated in a direction in which the link 60 linearly moves from the open end 67*a* of the guiding portion 67. The rotation preventing protrusion 64 provided in the support portion 62 of the link 60 is inserted into the rotation preventing guide portion 67*b*. Accordingly, when the link 60 linearly moves with respect to the guiding portion 67, the rotation preventing protrusion 64 of the link 60 moves along the rotation preventing guide portion 67*b*, so that the link 60 does not rotate with respect to the guiding portion 67.

The rotating member 70 is formed to be pivotally rotated by the linear motion of the link member 51, thereby moving the coupling 80 upward and downward. For example, the rotating member 70 may include a first rotational link 71, a second rotational link 72, and a rotational shaft 73.

One end 71*a* of the first rotational link 71 is inserted into the inserting hole 63 of the link 60 and connected to the link 60. The other end of the first rotational link 71 is rotatably disposed on the rotational shaft 73 supported by a fixing bracket 14 provided on the housing 13.

One end of the second rotational link 72 is rotatably connected to the rotational shaft 73, and the other end of the second rotational link 72 is formed to support the coupling 80. For example, the other end of the second rotational link 72 may be formed as two arms so as to stably support the coupling 80.

The rotational shaft 73 is provided with a torsion spring 75 for rotating the first rotational link 71 and the second rotational link 72 in a direction approaching each other. Further, the first rotational link 71 and the second rotational link 72 are provided with a first stopper and a second stopper, respectively, for limiting a range in which the first rotational link 71 and the second rotational link 72 are rotated by the torsion spring 75 in a direction in which the first rotational link 71 and the second rotational link 72 approach each other.

When the link 60 linearly moves in the direction away from the washing shaft 33 (the direction of arrow B), the first rotational link 71 rotates in the clockwise direction on the rotational shaft 73. When the first rotational link 71 rotates in the clockwise direction on the rotational shaft 73, the second rotational link 72 is urged by the torsion spring 75 to rotate in the clockwise direction on the rotational shaft 73 as the first rotational link 71.

When the clutch motor 90 is operated to apply a force to the link member 51 in the direction away from the washing shaft 33, the second rotational link 72 rotates in the clockwise direction on the rotational shaft 73 so that the coupling 80 supported by the second rotational link 72 is moved in the upward direction. Also, when a force is applied to the link member 51 by the clutch motor 90 so that the link member 51 moves in the direction approaching the washing shaft 33, the second rotational link 72 rotates in the counter-clockwise direction on the rotational shaft 73, so that the coupling 80 supported by the second rotational link 72 is moved in the downward direction.

Figure 12:
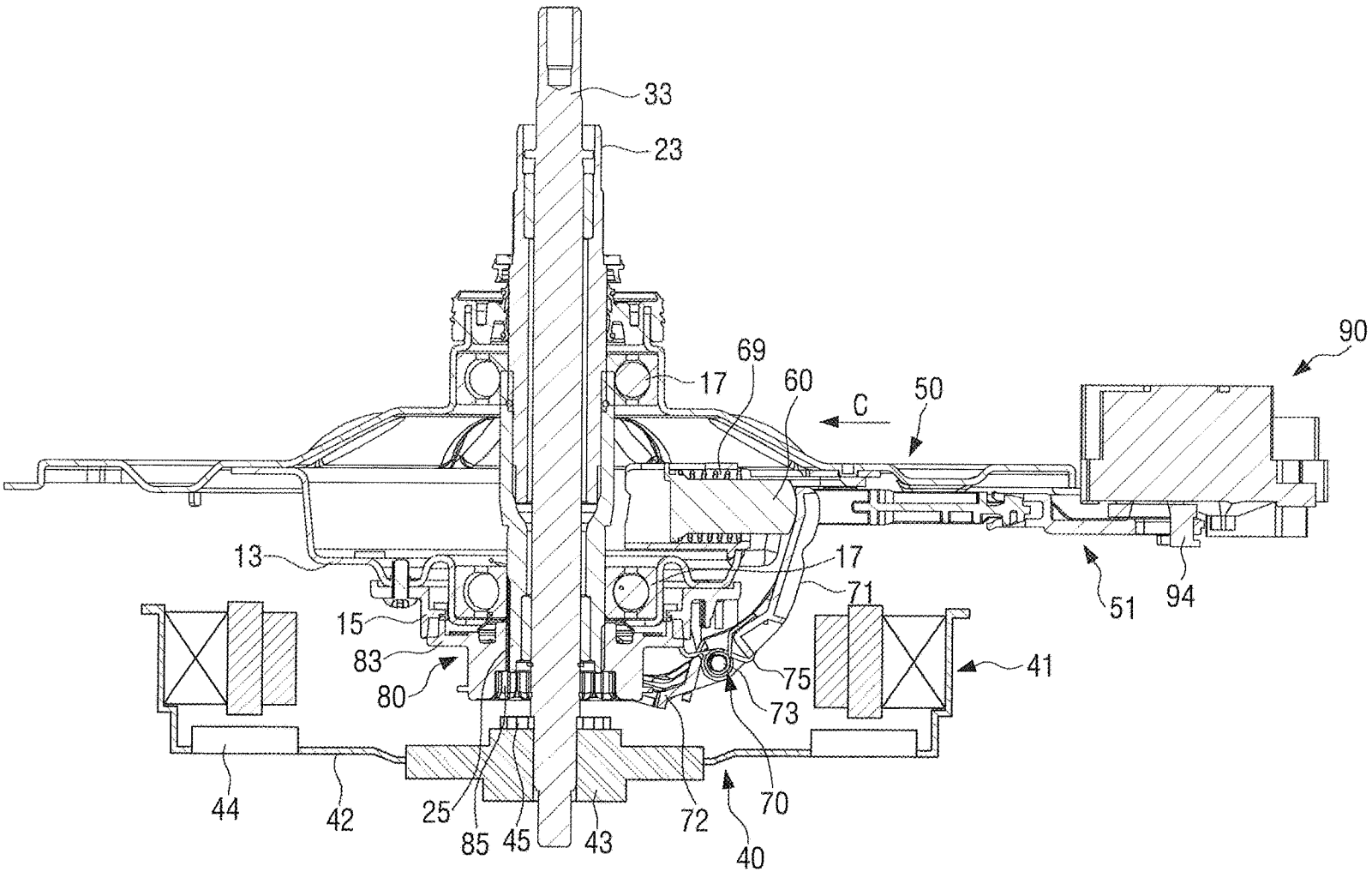
FIG. 12 is a cross-sectional view for explaining transmission of power of a driving device when a washing machine according to an embodiment of the present disclosure is operated in a washing mode.

The coupling 80 may be formed to be engaged with or to be separated from the driving device 40. In the present embodiment, as illustrated in FIG. 12, when the coupling 80 is lifted from a coupled position, the coupling 80 is separated from the driving device 40.

For example, the coupling 80 is disposed between the rotor 42 and the housing 13 of the washing tub 10, and is configured to be moved in the vertical direction by the rotating member 70 and to selectively transmit the rotational force to the dewatering shaft 23. The coupling 80 may include a through hole 81 through which the washing shaft 33 and the dewatering shaft 23 pass, an upper gear portion 83 and a lower gear portion 85 provided at the upper and lower ends of the coupling 80, and an inner serration 87 provided on the inner circumferential surface of the through hole 81.

The dewatering shaft 23 is formed to pass through the through hole 81, and the outer serration 25 provided on the outer circumferential surface of the dewatering shaft 23 is engaged with the inner serration 87 provided on the inner circumferential surface of the through hole 81. Accordingly, when the dewatering shaft 23 is inserted into the through hole 81 of the coupling 80, the inner serration 87 of the coupling 80 is engaged with the outer serration 25 of the dewatering shaft 23 so that the coupling 80 can move up and down along the dewatering shaft 23. Also, since the top end of the dewatering shaft 23 is connected to the dewatering tub 20, when the dewatering shaft 23 rotates, the dewatering tub 20 is rotated integrally with the dewatering shaft 23.

The washing shaft 33 is rotatably disposed inside the dewatering shaft 23. Since one end of the washing shaft 33 is connected to the pulsator 30 and the other end of the washing shaft 33 is axially connected to the circular plate 43 of the rotor 42, when the rotor 42 rotates, the washing shaft 33 always rotates. However, only when the rotor 42 and the dewatering shaft 23 are connected by the coupling 80, the dewatering shaft 23 is rotated together with the coupling 80, thereby rotating the dewatering tub 20.

When the coupling 80 moves in the downward direction along the dewatering shaft 23, the coupling 80 is closed to the circular plate 43 of the rotor 42, so that the lower gear portion 85 provided on the coupling 80 is engaged with the power transmission gear 45 provided on the circular plate 43. Hereinafter, it is assumed that the clutch unit 50 is located at a first position when the coupling 80 is adjacent to the rotor 42 so that the lower gear portion 85 of the coupling 80 is engaged with the power transmission gear 45 of the rotor 42.

In the case in which the lower gear portion 85 and the power transmission gear 45 are engaged with each other, when the rotor 42 rotates, the rotational force of the rotor 42 is transmitted to the coupling 80 via the power transmission gear 45 and the lower gear portion 85 to rotate the coupling 80. When the coupling 80 rotates, the dewatering shaft 23 is rotated integrally with the coupling 80 by the outer serration 25 engaged with the inner serration 87 of the coupling 80. When the dewatering shaft 23 rotates, the dewatering tub 20 is rotated integrally so that the first mode in which the dewatering tub 20 and the pulsator 30 rotate at the same time, that is, the dewatering mode is performed. Accordingly, in the dewatering mode, the clutch unit 50 is located at the first position.

When the coupling 80 is moved in the upward direction from the driving device 40 by the rotating member 70, the connection between the coupling 80 and the rotor 42 is released, so that the rotational force of the rotor 42 is not transmitted to the coupling 80. At this time, the upper gear portion 83 of the coupling 80 is engaged with the rotation preventing gear 15 provided on the bottom of the housing 13. Hereinafter, it is assumed that the clutch unit 50 is located at a second position when the coupling 80 is adjacent to the housing 13 so that the upper gear portion 83 of the coupling 80 is engaged with the rotation preventing gear 15 of the housing 13.

When the engagement between the lower gear portion 85 of the coupling 80 and the power transmission gear 45 of the rotor 42 is released and the upper gear portion 83 of the coupling 80 is engaged with the rotation preventing gear 15 of the housing 13, the coupling 80 is fixed to the housing 13 of the washing tub 10, so that the rotational force of the rotor 42 is not transmitted to the coupling 80. Accordingly, the dewatering shaft 23 is not rotated by the coupling 80. When the dewatering shaft 23 does not rotate, the second mode in which the dewatering tub 20 is not rotated and only the pulsator 30 is rotated by the rotor 42, that is, the washing mode is performed. Accordingly, in the washing mode, the clutch unit 50 is located at the second position.

Accordingly, when the coupling 80 is located at a position to be engaged with the driving device 40, the clutch unit 50 is operated in the first mode so that the dewatering tub 20 and the pulsator 30 rotate together, and when the coupling 80 is disengaged from the driving device 40, the clutch unit 50 is operated in the second mode so that the dewatering tub 20 does not rotate and only the pulsator 30 rotates.

The clutch motor 90 may be formed to switch the operation mode of the clutch unit 50 by moving the coupling 80 of the clutch unit 50 up and down by applying a predetermined force to the clutch unit 50.

Hereinafter, the clutch motor will be described in detail with reference to FIGS. 3, 8, and 9.

Figure 8:
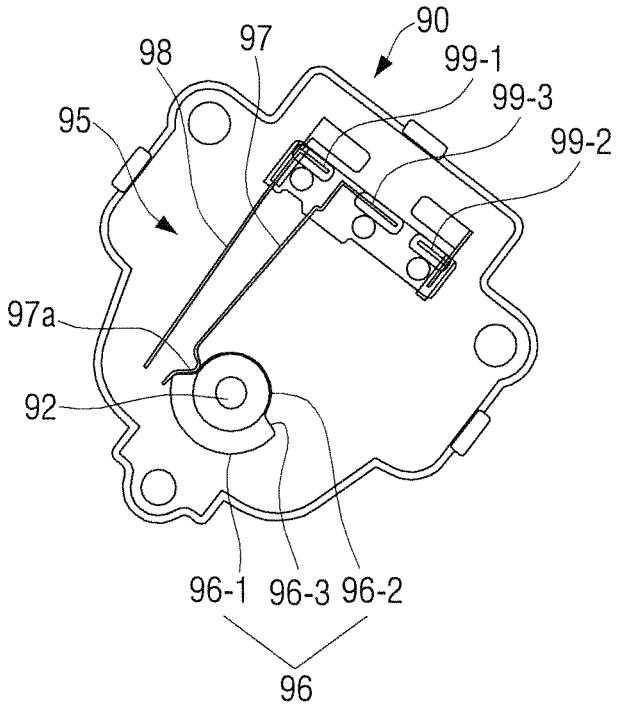
FIG. 8 is a view illustrating a cam switch of a clutch motor of a washing machine according to an embodiment of the present disclosure.
Figure 9:
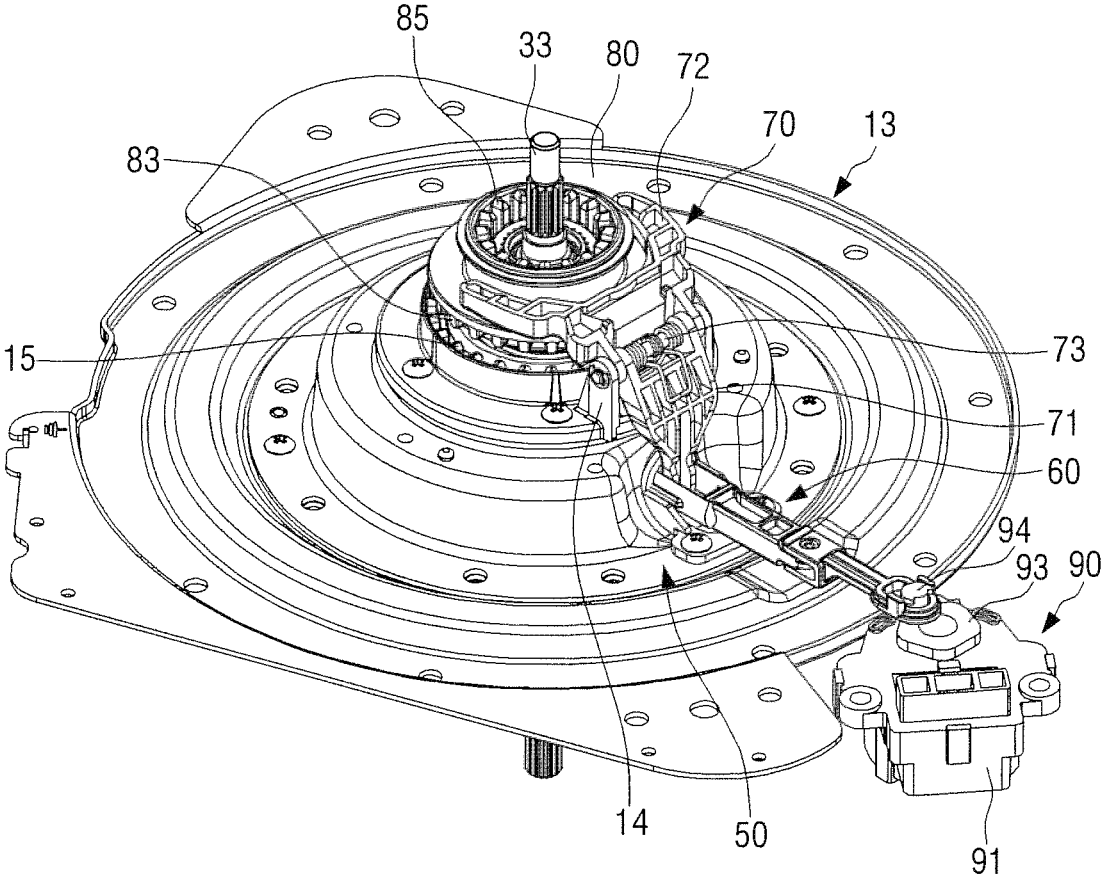
FIG. 9 is a bottom perspective view illustrating a clutch unit and a clutch motor when a washing machine according to an embodiment of the present disclosure is operated in a dewatering mode.

FIG. 8 is a view illustrating a cam switch of a clutch motor of a washing machine according to an embodiment of the present disclosure. FIG. 9 is a bottom perspective view illustrating a clutch unit and a clutch motor when a washing machine according to an embodiment of the present disclosure is operated in a dewatering mode. For reference, FIG. 8 shows the clutch motor from which a cover for covering the top surface of the cam switch and a rotational protrusion are removed.

The clutch motor 90 may include a motor portion 91 to generate a force for operating the clutch unit 50 and a cam switch 95 to output a signal in accordance with the rotation of the motor portion 91.

The motor portion 91 of the clutch motor 90 is configured such that when the power is applied, a motor shaft 92 rotates, and when the power is turned off, the motor shaft 92 stops. The motor portion 91 of the clutch motor 90 is the same as or similar to that of a normal clutch motor; therefore, a detailed description thereof is omitted.

The cam switch 95 is configured to be switched from a switch-off state to a switch-on state as the clutch motor 90 rotates. The cam switch 95 outputs pulses having the same period as the frequency of the alternating current (AC) power supplied to the clutch motor 90 in the switch-on state. On the other hand, when the cam switch 95 is switched from the switch-off state to the switch-on state, the operation of the clutch unit 50 is stopped. Also, when the cam switch 95 is switched from the switch-on state to the switch-off state, the operation of the clutch unit 50 is stopped.

For example, the cam switch 95 is provided on the surface from which the motor shaft 92 of the motor portion 91 projects, and may include a cam 96, a moving contact 97, and a stationary contact 98.

The cam 96 is formed to receive the rotational force from the clutch motor 90. For example, the cam 96 is fixed to the motor shaft 92 to rotate integrally with the motor shaft 92 of the clutch motor 90. The cam 96 moves the moving contact 97 by the rotation of the motor shaft 92 so that the moving contact 97 comes into contact with or is separated from the stationary contact 98. The cam 96 may include a pressing portion 96-1 formed in an arc of a predetermined angle on the motor shaft 92, a releasing portion 96-2 formed in connection with the pressing portion 96-1 and in an arc having a smaller radius than the pressing portion 96-1, and a connecting portion 96-3 connecting the pressing portion 96-1 and the releasing portion 96-2. The connecting portion 96-3 is formed to be inclined at a predetermined angle to form an obtuse angle with the releasing portion 96-2. Accordingly, when a side surface of the pressing portion 96-1 of the cam 96 is in contact with the moving contact 97, the moving contact 97 comes in contact with the stationary contact 98. Also, when the side surface of the releasing portion 96-2 of the cam 96 is in contact with the moving contact 97, the moving contact 97 is separated from the stationary contact 98.

The stationary contact 98 is provided to be spaced at a predetermined distance from a side of the cam 96, and is formed in a thin strip shape. The stationary contact 98 is in contact with or separated from the moving contact 97.

The moving contact 97 is provided to be in contact with the side surface of the cam 96. In detail, the moving contact 97 is disposed between the stationary contact 98 and the cam 96, is formed in a thin strip shape, and is provided with a projecting portion 97*a* to be in contact with the side surface of the cam 96 at one end of the moving contact 97. The projecting portion 97*a* is formed by bending the moving contact 97 to have an inclined surface corresponding to the inclination of the connecting portion 96-3 of the cam 96. One end of the moving contact 97 is fixed, and the other end provided with the projecting portion 97*a* is formed as a free end. Accordingly, when the pressing portion 96-1 of the cam 96 is in contact with the projecting portion 97*a* of the moving contact 97, the one end of the moving contact 97 is moved toward the stationary contact 98 and comes into contact with the stationary contact 98. When the releasing portion 96-2 of the cam 96 is in contact with the projecting portion 97*a* of the moving contact 97, the moving contact 97 is retracted by the elasticity to be separated from the stationary contact 98. In other words, the moving contact 97 is brought into contact with or separated from the stationary contact 98 by the cam 96. When the moving contact 97 is in contact with the stationary contact 98, the cam switch 95 becomes the switch-on state. Also, when the moving contact 97 is spaced from the stationary contact 98, the cam switch 95 becomes the switch-off state.

As illustrated in FIG. 8, the cam switch 95 may include three terminals, that is, two power terminals 99-1 and 99-2, and one switch terminal 99-3. The switch terminal 99-3 is provided between the two power terminals 99-1 and 99-2. The two power terminals 99-1 and 99-2 are electrically connected with a power source 110 supplying the AC power to the clutch motor 90, and one 99-1 of the two power terminals 99-1 and 99-2 is electrically connected with the stationary contact 98. The switch terminal 99-3 is electrically connected to the moving contact 97, and is also electrically connected to a controller 100. Accordingly, when the moving contact 97 is in contact with the stationary contact 98 so that the cam switch 95 becomes the switch-on state, the switch terminal 99-3 outputs pulses having the same period as the frequency of the AC power supplied to the clutch motor 90. The controller 100 may include various electronic components such as, for example, and without limitation, a microcomputer, etc., various circuitry and/or program modules configured to count the number of pulses output from the switch terminal 99-3. When the pulses output from the switch terminal 99-3 are a sinusoidal wave, they may be converted into a square wave and input to the controller 100.

Since the cam switch 95 is electrically connected to the controller 100 through the above-described three terminals 99-1, 99-2, and 99-3, when the moving contact 97 of the cam switch 95 is in contact with the stationary contact 98, the controller 100 recognizes that the cam switch 95 is switched on. Also, when the moving contact 97 of the cam switch 95 is separated from the stationary contact 98, the controller 100 recognizes that the cam switch 95 is switched off.

At the top end of the cam 96, a rotating plate 93 is provided coaxially with the cam 96. Accordingly, when the cam 96 is rotated by the motor shaft 92, the rotating plate 93 is also rotated integrally with the cam 96. On the top surface of the rotating plate 93, the rotational protrusion 94 is provided to be eccentric with the motor shaft 92. The rotational protrusion 94 is connected to the link member 51 of the clutch unit 50 as described above. In other words, the rotational protrusion 94 is inserted into the elongated hole of the hook portion 53 of the link member 51.

The rotational protrusion 94 and the cam 96 of the cam switch 95 are arranged to satisfy the following positional relationship in the dewatering mode and the washing mode.

The shape of the cam 96 and the rotational protrusion 94 may be formed and disposed such that at the time when the moving contact 97 is separated from the stationary contact 98 by the rotation of the cam 96 from the state in which the moving contact 97 is in contact with the stationary contact 98 so that the cam switch 95 is switched off, that is, when the controller 100 detects that the cam switch 95 is turned off, the coupling 80 is positioned at the dewatering mode position.

In detail, the rotational protrusion 94 and the cam 96 may be arranged and formed such that the moving contact 97 of the cam switch 95 is spaced apart from the stationary contact 98 when the rotational protrusion 94 activates the clutch unit 50 so that the coupling 80 of which the upper gear portion 83 is engaged with the rotation preventing gear 15 of the housing 13 and the lower gear portion 85 is spaced apart from the power transmission gear 45 of the rotor 42 is lowered so that the lower gear portion 85 of the coupling 80 is engaged with the power transmission gear 45 of the rotor 42, that is, when the clutch unit 50 is moved to the first position. For example, as illustrated in FIG. 10B, when the projecting portion 97*a* of the moving contact 97 is positioned at the connecting portion 96-3 of the cam 96, that is, when the vertex of the projecting portion 97*a* is positioned at a connection point between the connecting portion 96-3 and the releasing portion 96-2, the rotational protrusion 94 may be disposed at a position where the rotational protrusion 94 does not apply force to the link member 51. At this time, the rotational protrusion 94 is located closest to the clutch unit 50.

Also, the shape of the cam 96 and the rotational protrusion 94 may be formed and disposed such that at the time when the moving contact 97 comes into contact with the stationary contact 98 by the rotation of the cam 96 from the state in which the moving contact 97 is spaced apart from the stationary contact 98 so that the cam switch 95 is switched on, that is, when the controller 100 detects that the cam switch 95 is switched on, the coupling 80 is positioned at the washing mode position.

Figure 14A:
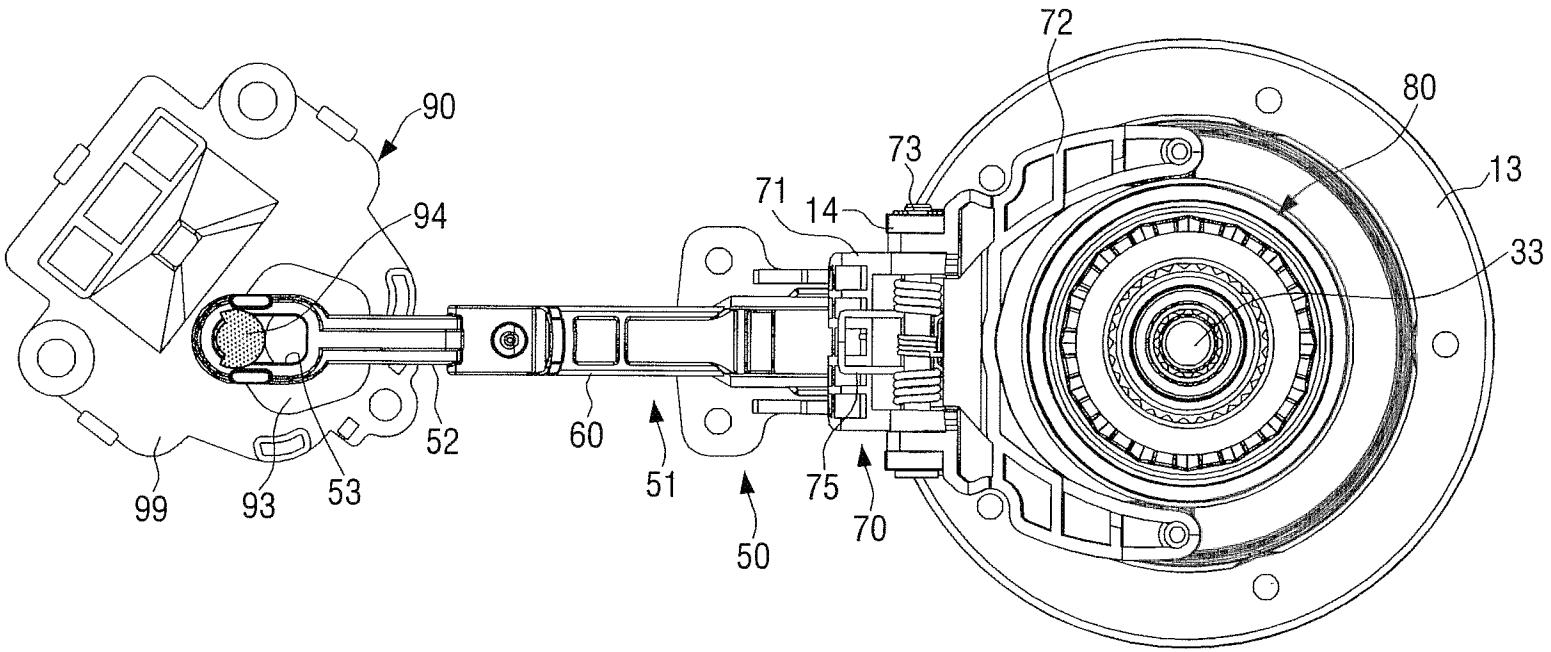
FIG. 14A is a view illustrating a relationship between a clutch motor and a link member of a clutch unit when a washing machine according to an embodiment of the present disclosure is operated in a washing mode.
Figure 14B:
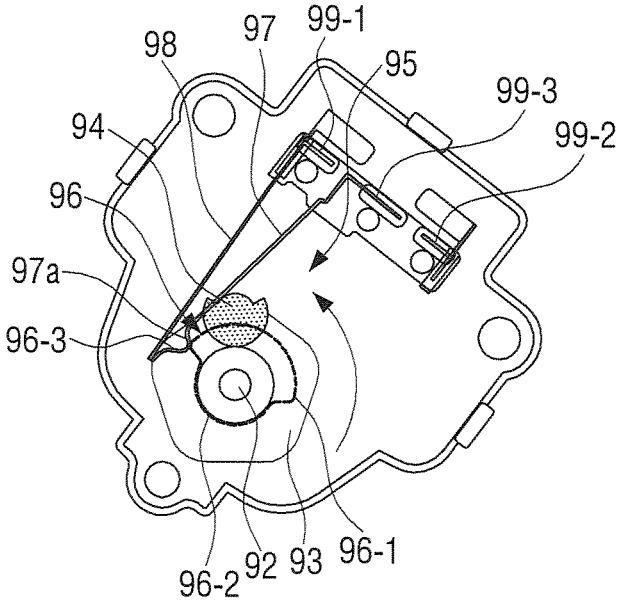
FIG. 14B is a view illustrating a cam switch of the clutch motor in a state of FIG. 14A.

In detail, the rotational protrusion 94 and the cam 96 may be arranged and formed such that the moving contact 97 of the cam switch 95 is in contact with the stationary contact 98 when the rotational protrusion 94 activates the clutch unit 50 to lift the coupling 80 of which the lower gear portion 85 is engaged with the power transmission gear 45 of the rotor 42 and the upper gear portion 83 is spaced apart from the rotation preventing gear 15 of the housing 13 so that the upper gear portion 83 of the coupling 80 is engaged with the rotation preventing gear 15 of the housing 13, that is, when the clutch unit 50 is moved to the second position. For example, as illustrated in FIG. 14B, when the projecting portion 97*a* of the moving contact 97 is positioned at a portion of the cam 96 where the connecting portion 96-3 and the pressing portion 96-1 are connected to each other, the rotational protrusion 94 may be disposed at a position where the rotational protrusion 94 applies force to the link member 51 so that the upper gear portion 83 of the coupling 80 of the clutch unit 50 is inserted into the rotation preventing gear 15 of the housing 13. At this time, the rotational protrusion 94 is located farthest from the clutch unit 50.

The washing machine 1 may include the controller 100 for controlling the driving motor 40 and the clutch motor 90 to perform the washing mode and the dewatering mode. The controller 100 is electrically connected to an input unit (not illustrated) to which user's commands are input, so that the user can select a washing course. The controller 100 may be configured to receive a signal from the cam switch 95 of the clutch motor 90, and to operate the clutch motor 90. Also, the controller 100 may be configured to count the number of pulses output from the cam switch 95. The configuration of the controller 100 is similar to the controller of a conventional washing machine; therefore, a detailed description thereof is omitted.

Hereinafter, in the washing machine according to an embodiment of the present disclosure having the above-described structure, operation of the washing machine when switching between a washing mode and a dewatering mode will be described in detail with reference to FIGS. 4, and 9 to 14B.

Figure 10A:
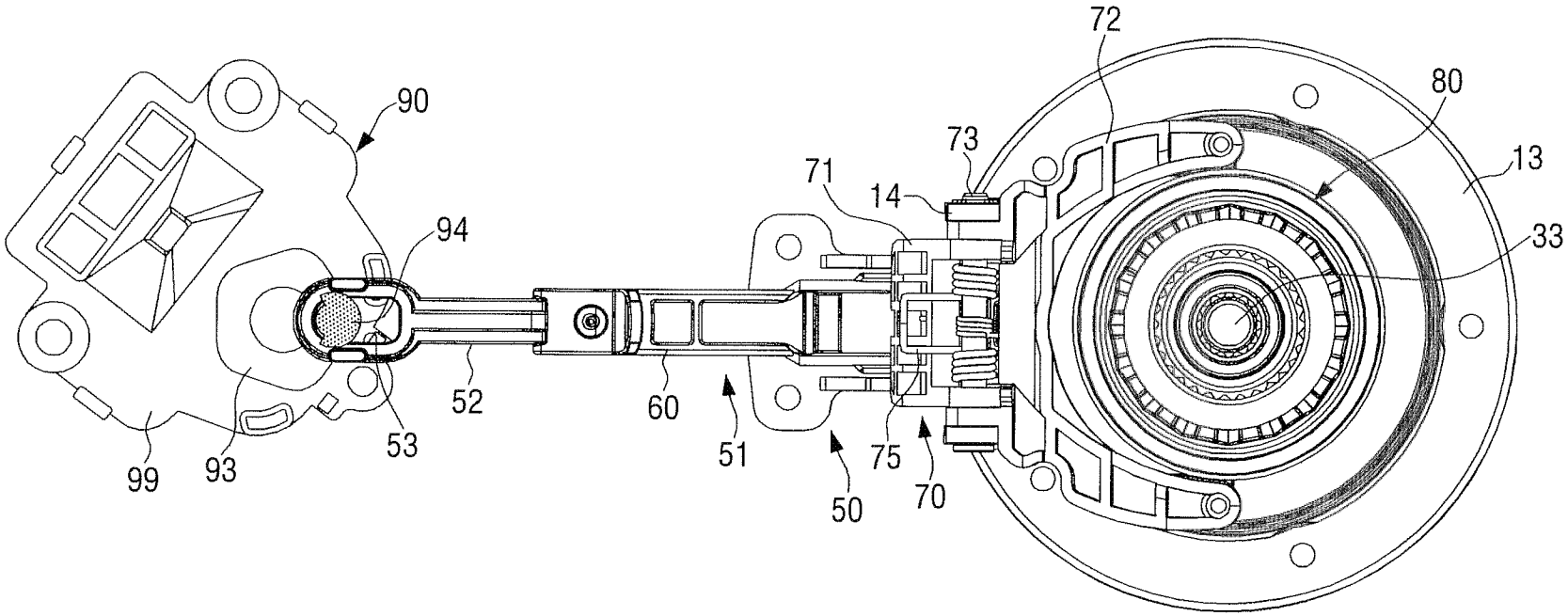
FIG. 10A is a view illustrating a relationship between a clutch motor and a link member of a clutch unit when a washing machine according to an embodiment of the present disclosure is operated in a dewatering mode.
Figure 10B:
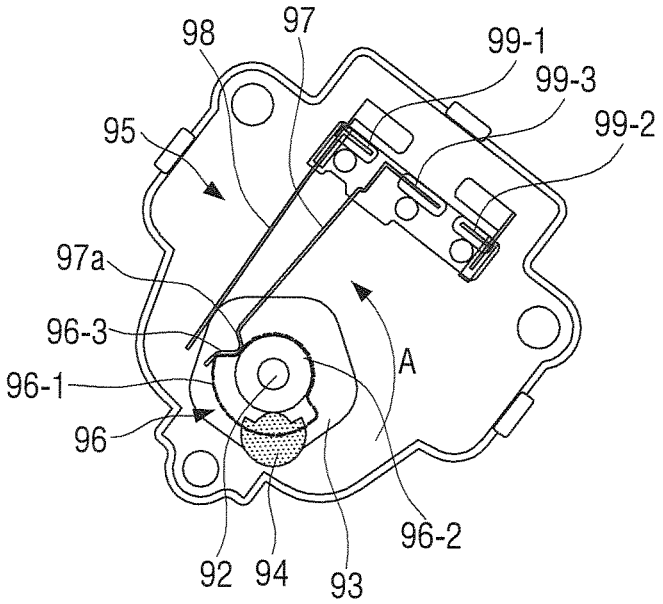
FIG. 10B is a view illustrating a cam switch of the clutch motor in a state of FIG. 10A.
Figure 13:
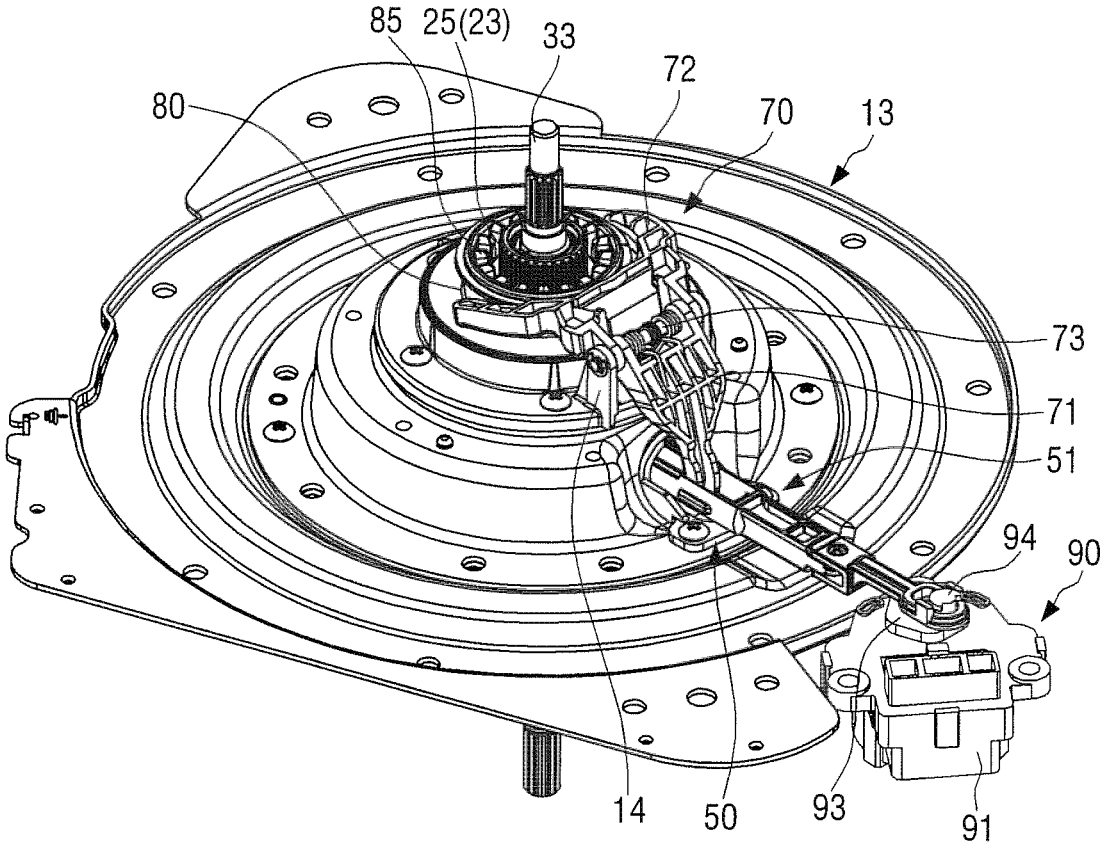
FIG. 13 is a bottom perspective view illustrating a clutch unit when a washing machine according to an embodiment of the present disclosure is operated in a washing mode.

FIG. 10A is a view illustrating a relationship between a clutch motor and a link member of a clutch unit when a washing machine according to an embodiment of the present disclosure is operated in a dewatering mode, and FIG. 10B is a view illustrating a cam switch of the clutch motor in a state of FIG. 10A. FIG. 11 is a view illustrating a relationship between a clutch motor and a link member when a washing machine according to an embodiment of the present disclosure is between a dewatering mode and a washing mode. FIG. 12 is a cross-sectional view for explaining transmission of power of a driving device when a washing machine according to an embodiment of the present disclosure is operated in a washing mode. FIG. 13 is a bottom perspective view illustrating a clutch unit when a washing machine according to an embodiment of the present disclosure is operated in a washing mode. FIG. 14A is a view illustrating a relationship between a clutch motor and a link member of a clutch unit when a washing machine according to an embodiment of the present disclosure is operated in a washing mode, and FIG. 14B is a view illustrating a cam switch of the clutch motor in a state of FIG. 14A.

First, in the case of switching from the washing mode to the dewatering mode, operation of the clutch unit 50 and the clutch motor 90 of the washing machine 1 will be described.

In the washing mode, the rotational protrusion 94 of the clutch motor 90 is located at the farthest position from the washing shaft 33. Accordingly, the link member 51 is moved in the outward direction from the washing shaft 33 to rotate the rotating member 70 in the clockwise direction, and then the rotating member 70 lifts the coupling 80 to separate the lower gear portion 85 of the coupling 80 from the power transmission gear 45 of the rotor 42. Accordingly, in the case of the washing mode, the rotational force of the driving motor 40 is not transmitted to the dewatering shaft 23, and only the washing shaft 33 provided in the rotor 42 rotates.

When switching from the washing mode to the dewatering mode, the controller 100 operates the clutch motor 90 to rotate the cam 96 provided on the motor shaft 92 in one direction (the direction of arrow A in FIG. 10B). When the cam 96 rotates, the rotational protrusion 94 provided integrally with the cam 96 also rotates. When the rotational protrusion 94 rotates in the direction of arrow A with a predetermined radius around the motor shaft 92, the link 60 of the link member 51 is linearly moved in the direction in which the link 60 of the link member 51 approaches the washing shaft 33 (the direction of arrow C in FIG. 12) by the hook portion 53 of the link member 51 into which the rotational protrusion 94 is inserted.

When the cam 96 is rotated a predetermined angle so that the projecting portion 97*a* of the moving contact 97 escapes from the pressing portion 96-1 of the cam 96 and is positioned at the connection point between the connecting portion 96-3 and the releasing portion 96-2, as illustrated in FIG. 10B, the moving contact 97 is separated from the stationary contact 98. In other words, the cam switch 95 is turned the off state. When the cam switch 95 is turned off, the controller 100 stops the clutch motor 90. The rotational protrusion 94 provided on the cam 96 is positioned closest to the washing shaft 33 at the time when the cam switch 95 is turned off.

When the rotational protrusion 94 is located nearest to the washing shaft 33, the link 60 of the link member 51 returns to the original position by the elastic force of the return spring 69. Then, the first rotational link 71 is rotated on the rotational shaft 73 in the counter-clockwise direction by the one end 71*a* of the first rotational link 71 of the rotating member 70 inserted into the inserting hole 63 of the link 60.

When the first rotational link 71 rotates in the counter-clockwise direction, the second rotational link 72 provided on the rotational shaft 73 also rotates in the counter-clockwise direction. When the second rotational link 72 rotates in the counter-clockwise direction, the coupling 80 engaged with the rotation preventing gear 15 of the housing 13 is moved downward along the dewatering shaft 23 by the second rotational link 72 so as to be separated from the rotation preventing gear 15, and the lower gear portion 85 of the coupling 80 is engaged with the power transmission gear 45 of the rotor 42 as illustrated in FIG. 4.

Accordingly, the rotational force of the rotor 42 is transmitted to the coupling 80 to rotate the coupling 80. When the coupling 80 rotates, the dewatering shaft 23 is rotated integrally with the coupling 80 by the outer serration 25 engaged with the inner serration 87 of the coupling 80. When the dewatering shaft 23 rotates, the dewatering tub 20 connected to the dewatering shaft 23 is rotated integrally with the dewatering shaft 23. Therefore, the dewatering mode in which the dewatering tub 20 and the pulsator 30 are rotated together is performed by the driving motor 40.

As described above, at the time when the cam switch 95 is turned off by the rotation of the cam 96, that is, when the cam 96 rotates so that the projecting portion 97*a* of the moving contact 97 comes into contact with the releasing portion 96-2 from the pressing portion 96-1 through the connecting portion 96-3, the clutch unit 50 lowers the coupling 80 to allow the lower gear portion 85 of the coupling 80 to be engaged with the power transmission gear 45 of the rotor 42 so that the rotational force of the rotor 42 is simultaneously transmitted to the washing shaft 33 and the dewatering shaft 23. In other words, the clutch unit 50, the rotational protrusion 94, and the cam switch 95 may be arranged so that when the coupling 80 of the clutch unit 50 is engaged with the power transmission gear 45 of the rotor 42 is when the cam switch 95 is turned from the on state to the off state. At the time when the cam switch 95 is turned off from the on state, the controller 100 stops the clutch motor 90, so that the coupling 80 remains in a state in which the coupling 80 is connected to the rotor 42. According to the present disclosure as described above, in the case of switching from the washing mode to the dewatering mode, at the time when the coupling 80 starts to transmit the rotational force of the rotor 42 to the dewatering shaft 23, the cam switch 95 outputs an off signal so that the clutch motor 90 is stopped.

Accordingly, in the case of the present disclosure, unlike the prior art, after the moving contact 97 comes into contact with the stationary contact 98, the cam 96 does not need to further rotate for a predetermined time. Therefore, there is no case where the stop position of the cam 96 is changed due to noise caused by the poor power supply environment.

Next, in the case of switching from dewatering mode to the washing mode, operation of the clutch unit 50 and the clutch motor 90 of the washing machine 1 will be described.

In the dewatering mode, the rotational protrusion 94 of the clutch motor 90 is positioned closest to the washing shaft 33 as described above. At this time, the lower gear portion 85 of the coupling 80 is engaged with the power transmission gear 45 of the rotor 42. Accordingly, in the dewatering mode, the power of the driving motor 40 is simultaneously transmitted to the dewatering shaft 23 and the washing shaft 33, so that the washing shaft 33 and the dewatering shaft 23 rotates at the same time. Therefore, the pulsator 30 and the dewatering tub 20 connected to the washing shaft 33 and the dewatering shaft 23 rotate simultaneously.

When switching from the dewatering mode to the washing mode, the controller 100 operates the clutch motor 90 to rotate the cam 96 provided on the motor shaft 92 in one direction (the direction of arrow A in FIGS. 14A and 14B). When the cam 96 rotates, the rotational protrusion 94 provided integrally with the cam 96 also rotates. When the rotational protrusion 94 rotates in the direction of arrow A with a predetermined radius around the motor shaft 92, the link 60 of the link member 51 is linearly moved in the direction away from the washing shaft 33 by the hook portion 53 of the link member 51 into which the rotational protrusion 94 is inserted.

When the cam 96 is rotated a predetermined angle so that the projecting portion 97*a* of the moving contact 97 escapes from the releasing portion 96-2 of the cam 96 and is positioned at the connection point between the connecting portion 96-3 and the pressing portion 96-1, as illustrated in FIG. 14B, the moving contact 97 comes into contact with the stationary contact 98. In other words, the cam switch 95 becomes the on state. The rotational protrusion 94 provided on the cam 96 is positioned at the farthest position from the washing shaft 33 at the time when the cam switch 95 is turned on.

When the rotational protrusion 94 is located at the farthest position from the washing shaft 33, a tensile force acts on the link member 51 so that the link 60 of the link member 51 is moved linearly in the direction away from the washing shaft 33. Then, the first rotational link 71 is rotated on the rotational shaft 73 in the clockwise direction by the one end 71*a* of the first rotational link 71 of the rotating member 70 inserted into the inserting hole 63 of the link 60.

When the first rotational link 71 rotates in the clockwise direction, the second rotational link 72 provided on the rotational shaft 73 also rotates in the clockwise direction. When the second rotational link 72 rotates in the clockwise direction, the coupling 80 engaged with the power transmission gear 45 of the rotor 42 is moved upward along the dewatering shaft 23 by the second rotational link 72 so as to be separated from the power transmission gear 45, and the upper gear portion 83 of the coupling 80 is engaged with the rotation preventing gear 15 of the housing 13 as illustrated in FIG. 12.

Accordingly, the rotational force of the rotor 42 is not transmitted to the coupling 80, so that the coupling 80 does not rotate. At this time, since the upper gear portion 83 of the coupling 80 is engaged with the rotation preventing gear 15 of the housing 13, the dewatering shaft 23 does not rotate even if the washing shaft 33 rotates. Accordingly, the washing mode in which only the pulsator 30 rotates and the dewatering tub 20 does not rotate is performed by the driving motor 40.

As described above, at the time when the cam switch 95 is turned on by the rotation of the cam 96, that is, when the cam 96 rotates so that the projecting portion 97*a* of the moving contact 97 comes into contact with the pressing portion 96-1 from the releasing portion 96-2 through the connecting portion 96-3, the clutch unit 50 lifts the coupling 80 to allow the upper gear portion 83 of the coupling 80 to be engaged with the rotation preventing gear 15 of the housing 13 so that the rotational force of the rotor 42 is not transmitted to the dewatering shaft 23. In other words, the clutch unit 50, the rotational protrusion 94, and the cam switch 95 may be arranged so that when the coupling 80 of the clutch unit 50 is engaged with the rotation preventing gear 15 of the housing 13 becomes when the cam switch 95 is turned on from the off state to the on state. At the time when the cam switch 95 is turned on from the off state, the controller 100 stops the clutch motor 90, so that the coupling 80 remains in a state in which the coupling 80 is separated from the rotor 42 and is connected to the housing 13. According to the present disclosure as described above, in the case of switching from the dewatering mode to the washing mode, at the time when the coupling 80 is engaged with the rotation preventing gear 15 of the housing 13, that is, when the clutch unit 50 is located at the second position, the cam switch 95 outputs an on signal so that the clutch motor 90 is stopped.

Accordingly, in the case of the present disclosure, unlike the prior art, after the moving contact 97 is separated from the stationary contact 98, the cam 96 does not need to further rotate for a predetermined time. Therefore, there is no case where the stop position of the cam 96 of the clutch motor 90 is changed due to noise caused by the poor power supply environment, so that the coupling 80 is not completely engaged with the rotation preventing gear 15 of the housing 13.

Hereinafter, a control method of a washing machine according to an embodiment of the present disclosure will be described with reference to FIGS. 15 and 16.

Figure 15:
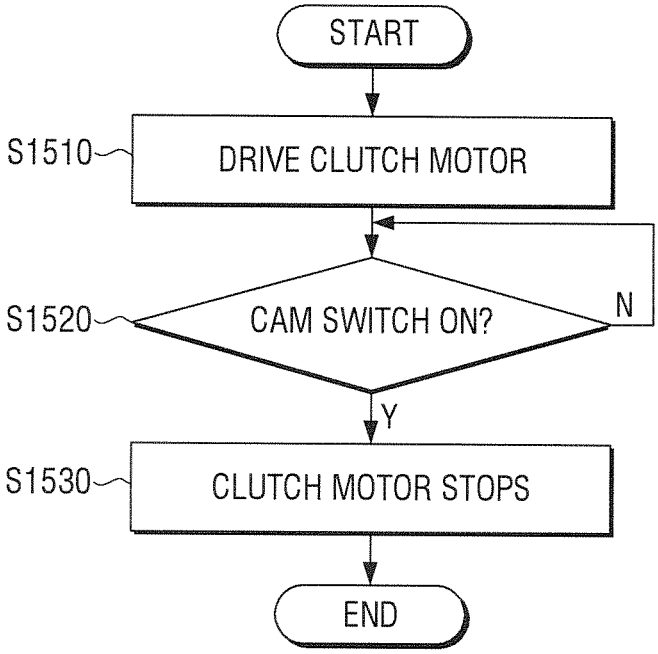
FIG. 15 is a flowchart illustrating a control method of a washing machine according to an embodiment of the present disclosure in a case of switching from a dewatering mode to a washing mode.
Figure 16:
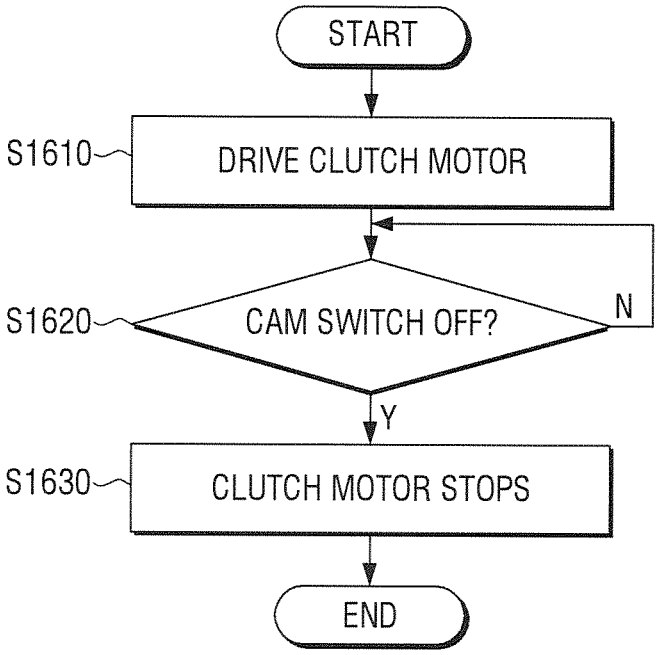
FIG. 16 is a flowchart illustrating a control method of a washing machine according to an embodiment of the present disclosure in a case of switching from a washing mode to a dewatering mode.

FIG. 15 is a flowchart illustrating a control method of a washing machine according to an embodiment of the present disclosure in a case of switching from a dewatering mode to a washing mode, and FIG. 16 is a flowchart illustrating a control method of a washing machine according to an embodiment of the present disclosure in a case of switching from a washing mode to a dewatering mode.

First, a control method of a washing machine when switching from a dewatering mode to a washing mode will be described with reference to FIG. 15.

When a command to switch from the dewatering mode to the washing mode is input, the controller drives the clutch motor (S1510).

In the dewatering mode, since the cam switch is in the switch-off state, that is, the movable contact is separated from the stationary contact, the cam switch does not output the pulse signal. At this time, the controller recognizes that a low signal is input from the cam switch. Accordingly, when the signal inputted from the cam switch is a low signal, the controller recognizes that the cam switch is in the switch-off state.

Subsequently, the controller determines whether the cam switch is turned on (S1520). When the moving contact of the cam switch comes into contact with the stationary contact, the cam switch outputs an on signal, for example, a pulse signal outputted from the switch terminal of the cam switch, that is, a high signal. When the controller receives the pulse signal from the cam switch, the controller determines that the cam switch is turned on.

When the cam switch is turned on, the clutch unit is located at the second position. Accordingly, the coupling of the clutch unit moves upward, so that the upper gear portion is engaged with the rotation preventing gear of the housing. Therefore, since the rotational force of the rotor is not transmitted to the dewatering shaft, the washing mode in which only the washing shaft connected to the rotor rotates and the dewatering tub does not rotate is performed.

When it is determined that the cam switch is turned on, the controller stops the clutch motor (S1530). When the clutch motor 90 stops, the operation of the clutch unit 50 is stopped. At this time, since the clutch unit is located at the second position by the clutch motor, the washing machine performs the second mode, that is, the washing mode.

Next, the control method of the washing machine when switching from the washing mode to the dewatering mode will be described with reference to FIG. 16.

When a command to switch from the washing mode to the dewatering mode is input, the controller drives the clutch motor (S1610).

In the case where the clutch unit is in the washing mode, that is, the second mode, since the cam switch is in the switch-on state, that is, the movable contact is in contact with the stationary contact, the cam switch outputs pulses, that is, the high signal. Accordingly, when the pulse signal is input from the cam switch, the controller recognizes that the cam switch is in the switch-on state.

Subsequently, the controller determines whether the cam switch is turned off (S1620). When the clutch motor is operated so that the moving contact of the cam switch is separated from the stationary contact, the cam switch outputs an off signal. For example, the cam switch outputs a pulse signal when the cam switch is in the on state, and the cam switch does not output the pulse signal when the cam switch is turned off. At this time, the controller recognizes that a low signal is inputted from the cam switch.

Accordingly, when the controller does not receive the pulse signal from the cam switch, that is, when the low signal is input, the controller determines that the cam switch is turned off. When the cam switch is turned off, the clutch unit is located at the first position. Accordingly, the coupling of the clutch unit moves downward, so that the lower gear portion is engaged with the power transmission gear of the rotor. Therefore, since the rotational force of the rotor is transmitted to the dewatering shaft through the coupling, the rotational force of the rotor is transmitted to both the washing shaft and the dewatering shaft, so that the dewatering mode in which the pulsator and the dewatering tub rotate together is performed.

When the controller determines that the cam switch is turned off, the controller stops the clutch motor (S1630). At this time, since the clutch unit is located at the first position by the rotational protrusion of the clutch motor, the washing machine performs the dewatering mode.

Hereinafter, a control method of the washing machine having the above-described structure according to another embodiment of the present disclosure will be described with reference to FIGS. 17 and 18.

Figure 17:
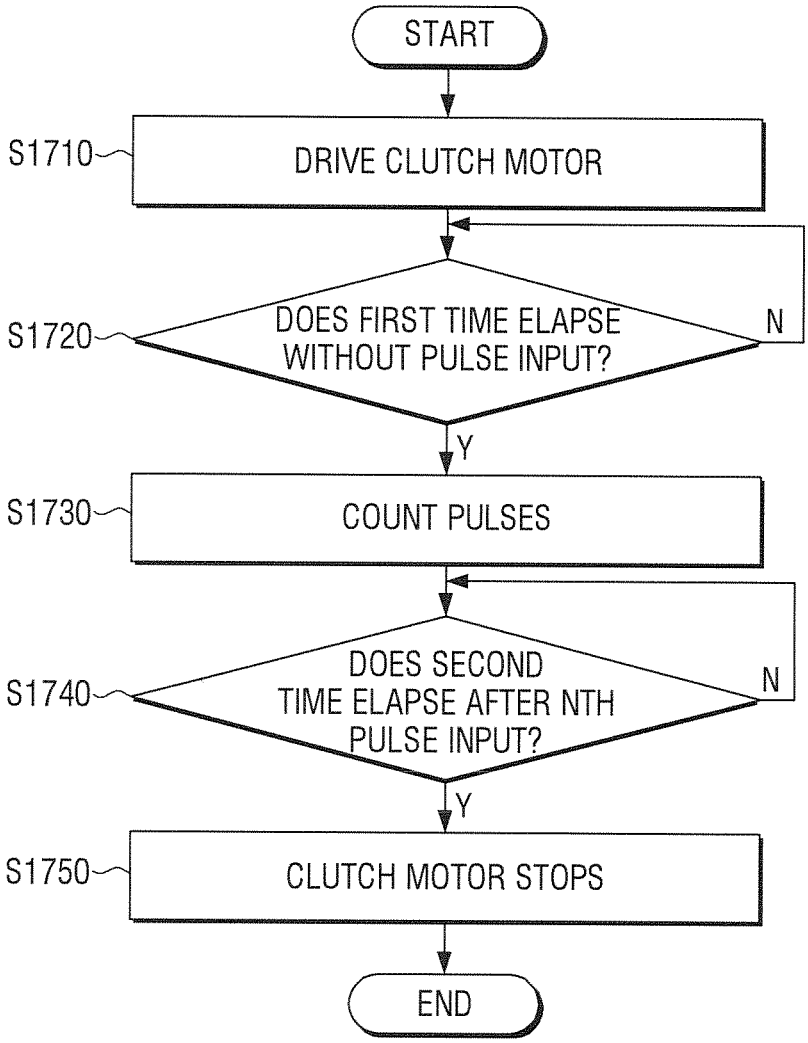
FIG. 17 is a flowchart illustrating a control method of a washing machine according to another embodiment of the present disclosure in a case of switching from a dewatering mode to a washing mode.
Figure 18:
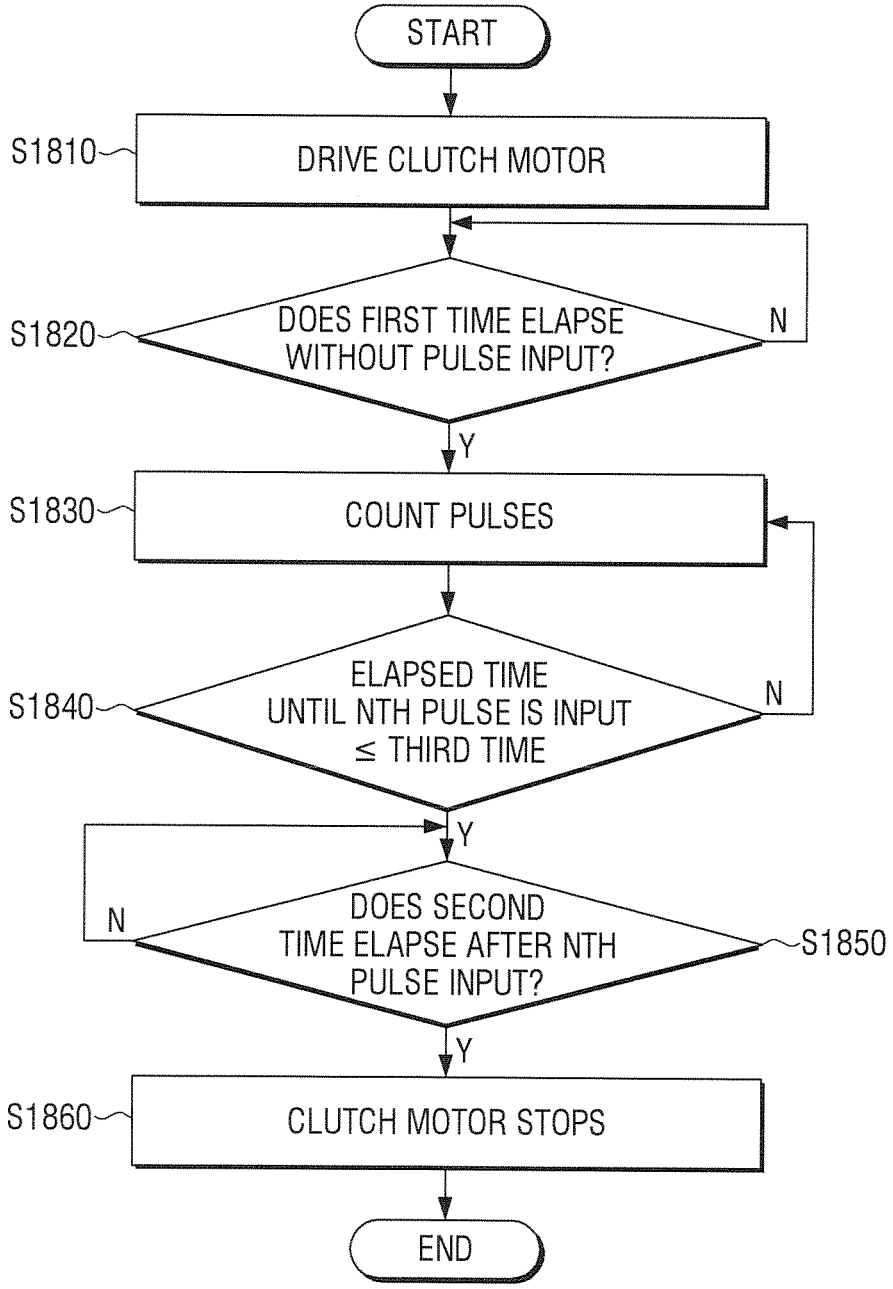
FIG. 18 is a flowchart illustrating a control method of a washing machine according to another embodiment of the present disclosure in a case of switching from a dewatering mode to a washing mode.

FIG. 17 is a flowchart illustrating a control method of a washing machine according to another embodiment of the present disclosure in a case of switching from a dewatering mode to a washing mode, and FIG. 18 is a flowchart illustrating a control method of a washing machine according to another embodiment of the present disclosure in a case of switching from a dewatering mode to a washing mode.

First, a control method of the washing machine when switching from the dewatering mode to the washing mode will be described with reference to FIG. 17.

When a command to switch from the dewatering mode to the washing mode is input, the controller drives the clutch motor in the stopped state (S1710).

In the dewatering mode, since the cam switch is in the switch-off state, that is, the movable contact is separated from the stationary contact, the cam switch does not output the pulse signal. At this time, the controller recognizes that a low signal is input from the cam switch. Accordingly, when the signal inputted from the cam switch is the low signal, the controller recognizes that the cam switch is in the switch-off state.

Subsequently, the controller determines whether a predetermined first time has elapsed from when the pulse signal is not input from the cam switch, that is, when the low signal is input (S1720). At this time, the first time may be set to one second or less. For example, the first time may be set to 100 ms.

When the clutch motor operates, the cam provided on the clutch motor rotates to bring the moving contact into contact with the stationary contact. When the moving contact of the cam switch comes into contact with the stationary contact, the cam switch outputs a pulse signal having the same period as the frequency of the AC power supplied to the clutch motor. When the controller receives the pulse signal from the cam switch after the lapse of the first time, the controller counts the number of the input pulses (S1730).

When the number of pulses input from the cam switch becomes N, that is, when the Nth pulse is input from the cam switch, the controller determines whether a predetermined second time has elapsed since the Nth pulse was input (S1740). At this time, N may be three or more as a natural number. For example, N may be set to five. In addition, the second time may be set differently depending on the frequency of the AC power to no more than five seconds. For example, when the frequency of the AC power is 60 Hz, the second time may be set to 3.78 seconds. When the frequency of the AC power is 50 Hz, the second time may be set to 4.53 seconds.

When it is determined that second time has elapsed since the Nth pulse was input, the controller stops the clutch motor (S1750). For example, the controller stops the clutch unit when it is determined that 3.78 seconds have elapsed since the fifth pulse was input from the cam switch.

At this time, the cam switch is switched in the on state, and the clutch unit becomes the second mode in which the clutch unit is located at the second position by the clutch motor. Accordingly, the coupling of the clutch unit moves upward, so that the upper gear portion is engaged with the rotation preventing gear of the housing. Therefore, since the rotational force of the rotor is not transmitted to the dewatering shaft, the washing mode in which only the washing shaft connected to the rotor rotates is performed.

As described above, the controller may determine whether the input pulse is due to noise by counting the number of pulses input from the cam switch.

Hereinafter, a control method of the washing machine when switching from the dewatering mode to the washing mode according to another embodiment will be described with reference to FIG. 18.

When a command to switch from the dewatering mode to the washing mode is input, the controller drives the clutch motor in the stopped state (S1810).

The controller confirms whether the cam switch is in the switch-off state. When the clutch unit is in the dewatering mode, that is, the first mode, the cam switch is in the switch-off state, that is, the movable contact is separated from the stationary contact, so that the cam switch does not output the pulse signal. Accordingly, when the signal inputted from the cam switch is the low signal, the controller recognizes that the cam switch is in the switch-off state.

Subsequently, the controller determines whether a predetermined first time has elapsed from when the pulse signal is not input from the cam switch (S1720). At this time, the first time may be set to one second or less. For example, the first time may be set to 100 ms.

When the clutch motor operates, the cam provided on the clutch motor rotates to bring the moving contact into contact with the stationary contact. When the moving contact of the cam switch comes into contact with the stationary contact, the cam switch outputs a pulse signal having the same period as the frequency of the AC power supplied to the clutch motor. When the controller receives the pulse signal from the cam switch after the lapse of the first time, the controller counts the number of the input pulses (S1830).

Subsequently, the controller determines whether an elapsed time until the Nth pulse is input after starting to count the pulses input from the cam switch, that is, the time taken until the Nth pulse is input from the time when the first pulse is input is within a predetermined third time. At this time, N may be three or more as a natural number. For example, N may be set to five. Also, the third time may be set to one second or less. For example, the third time may be set to 200 ms.

If it is determined that the predetermined third time has elapsed before the Nth pulse is input after the pulse input from the cam switch is counted, the controller counts again from the pulse input after the third time elapsed. In detail, the controller measures the time while counting the number of pulses from the time when the first pulse is input. If the third time elapses before the Nth pulse is input, the controller ignores the number of pulses counted to the present and counts again the number of pulses from the pulse input after the third time elapses. For example, in the case in which N is five and the third time is 200 ms, when the elapsed time from the input of the first pulse to the input of the third pulse exceeds 200 ms, the controller re-counts the number of pulses after setting the fourth pulse as a first pulse.

If the elapsed time until the Nth pulse is input is less than or equal to the third time, the controller determines whether the predetermined second time has elapsed after the Nth pulse is input (S1850). In other words, the controller measures the time from the time when the Nth pulse is input, and determines whether the predetermined second time elapses. For example, when the fifth pulse is input at 190 ms, the controller measures the time again from the time when the fifth pulse is input, and determines whether or not the second time has elapsed. At this time, the second time may be set differently depending on the frequency of the AC power to five seconds or less. For example, when the frequency of the AC power is 60 Hz, the second time may be set to 3.78 seconds. When the frequency of the AC power is 50 Hz, the second time may be set to 4.53 seconds.

When it is determined that second time has elapsed since the Nth pulse was input, the controller stops the clutch motor (S1860). For example, the controller stops the clutch motor when it is determined that 3.78 seconds have elapsed since the fifth pulse was input from the cam switch.

At this time, the cam switch is switched on, and the clutch unit becomes the second mode in which the clutch unit is located at the second position by the clutch motor. Accordingly, the coupling of the clutch unit moves upward, so that the upper gear portion is engaged with the rotation preventing gear of the housing. Therefore, since the rotational force of the rotor is not transmitted to the dewatering shaft, the washing mode in which only the washing shaft connected to the rotor rotates is performed.

As described above, the controller may determine whether the input pulse is due to noise by counting the number of pulses input from the cam switch and measuring the time between the input pulses, thereby preventing the washing machine from malfunctioning due to noise.

Hereinafter, a control method of the washing machine having the above-described structure according to another embodiment of the present disclosure will be described with reference to FIGS. 19 and 20.

Figure 19:
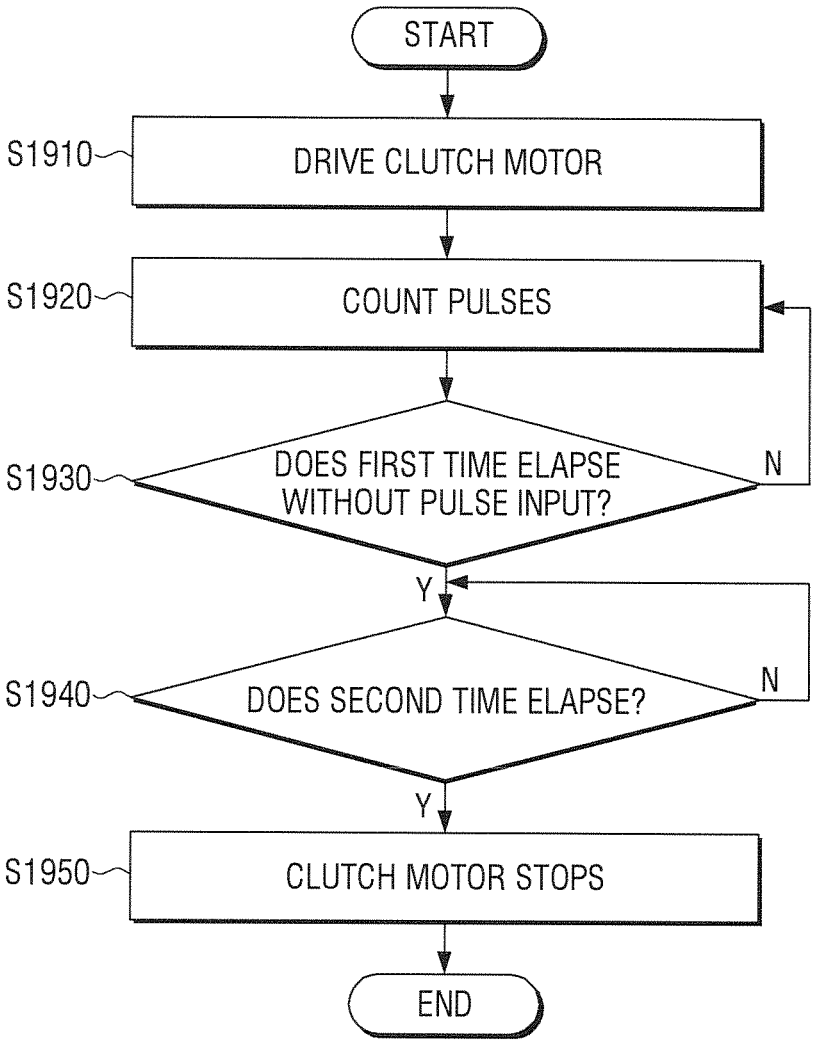
FIG. 19 is a flowchart illustrating a control method of a washing machine according to another embodiment of the present disclosure in a case of switching from a washing mode to a dewatering mode.
Figure 20:
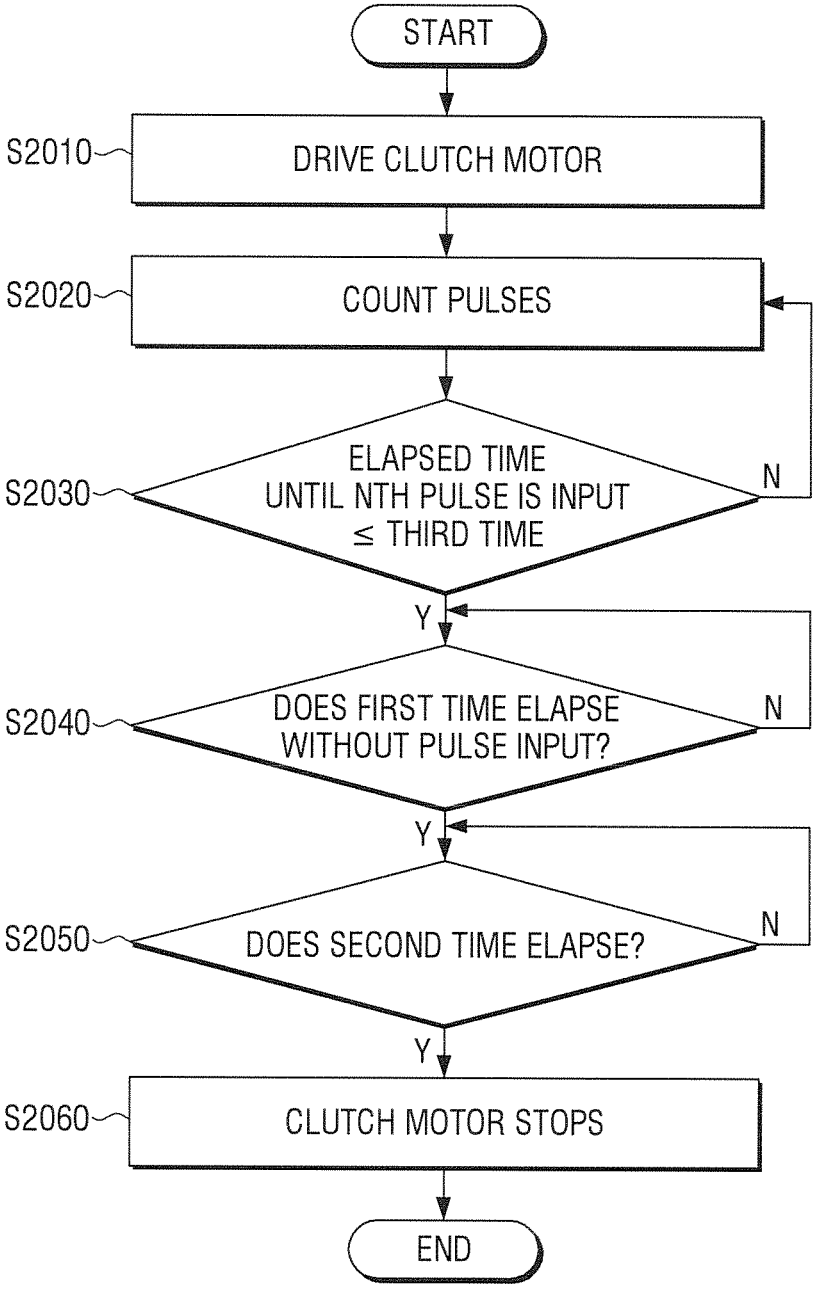
FIG. 20 is a flowchart illustrating a control method of a washing machine according to another embodiment of the present disclosure in a case of switching from a washing mode to a dewatering mode.

FIG. 19 is a flowchart illustrating a control method of a washing machine according to another embodiment of the present disclosure in a case of switching from a washing mode to a dewatering mode, and FIG. 20 is a flowchart illustrating a control method of a washing machine according to another embodiment of the present disclosure in a case of switching from a washing mode to a dewatering mode.

A control method of the washing machine when switching from the washing mode to the dewatering mode according to another embodiment will be described with reference to FIG. 20.

When a command to switch from the washing mode to the dewatering mode is input, the controller drives the clutch motor (S1910).

Subsequently, the controller counts the number of pulses input from the cam switch (S1920). Thus, the controller confirms whether the cam switch is in the switch-on state. In the case where the clutch unit is in the washing mode, that is, the second mode, the cam switch is in the switch-on state, that is, the movable contact is in contact with the stationary contact, so that pulses, that is, a high signal is output from the cam switch. Accordingly, when the pulse signal is input from the cam switch, the controller recognizes that the cam switch is in the switch-on state.

When the clutch motor is operated, the cam moves so that the movable contact is separated from the stationary contact. When the moving contact is separated from the stationary contact, the cam switch is switched off without outputting pulses. At this time, the controller recognizes that a low signal is input from the cam switch. Accordingly, when the signal inputted from the cam switch is the low signal, the controller recognizes that the cam switch is in the switch-off state.

The controller determines whether a predetermined first time has elapsed from when the pulse signal is not input from the cam switch, that is, when the low signal is input (S1930). In detail, the controller measures the time from the time when the low signal is input, and determines whether the measured time exceeds the first time. Thus, the controller determines whether the cam switch is in the switch-off state. If the pulse is input again within the first time, the controller measures the time from the time when a low signal is input again. At this time, the first time may be set to one second or less. For example, the first time may be set to 100 ms.

After the first time has elapsed, the controller determines a predetermined second time has elapsed (S1940). In detail, when the time measured from the time when the low signal is inputted exceeds the first time, the controller measures the time again from the time when the first time elapses, and determines whether the predetermined second time elapses. At this time, the second time may be set differently depending on the frequency of the AC power to no more than five seconds. For example, when the frequency of the AC power is 60 Hz, the second time may be set to 3.5 seconds. When the frequency of the AC power is 50 Hz, the second time may be set to 4.22 seconds.

When the cam switch is switched off, the clutch unit is switched to the first mode. Accordingly, the coupling of the clutch unit moves downward, so that the lower gear portion is engaged with the power transmission gear of the rotor. Therefore, since the rotational force of the rotor is transmitted to the dewatering shaft through the coupling, the rotational force of the rotor is transmitted to both the washing shaft and the dewatering shaft, so that the dewatering mode in which the pulsator and the dewatering tub rotate together is performed.

When the controller determines that the cam switch is turned off, the controller stops the clutch motor (S1950). At this time, since the clutch unit is located at the first position by the clutch motor, the washing machine performs the dewatering mode.

Hereinafter, a control method of the washing machine when switching from the washing mode to the dewatering mode according to another embodiment will be described with reference to FIG. 20.

When a command to switch from the washing mode to the dewatering mode is input, the controller drives the clutch motor (S2010).

Subsequently, the controller counts the number of pulses input from the cam switch (S2020). Thus, the controller confirms whether the cam switch is in the switch-on state. In the case where the clutch unit is in the washing mode, that is, the second mode, the cam switch is in the switch-on state, that is, the movable contact is in contact with the stationary contact, so that pulses, that is, a high signal is output from the cam switch. Accordingly, when the pulse signal is inputted from the cam switch, the controller recognizes that the cam switch is in the switch-on state.

Next, the controller determines whether the elapsed time until the Nth pulse is input after starting to count the number of the pulses input from the cam switch, that is, the time taken until the Nth pulse is input from the time when the first pulse is input is within a predetermined third time (S2030). At this time, N may be three or more as a natural number. For example, N may be set to five. Also, the third time may be set to one second or less. For example, the third time may be set to 200 ms.

If it is determined that the predetermined third time has elapsed before the Nth pulse is input after the pulses input from the cam switch are counted, the controller counts again from the pulse input after the third time elapsed. In detail, the controller measures the time while counting the number of pulses from the time when the first pulse is input. If the third time elapses before the Nth pulse is input, the controller ignores the number of pulses counted to the present and counts the number of pulses again from the pulse input after the third time elapses.

When the elapsed time until the Nth pulse is input is equal to or less than the third time, the controller proceeds to the next operation after the Nth pulse is input.

When the clutch motor is operated, the cam moves so that the movable contact is separated from the stationary contact. When the moving contact is separated from the stationary contact, the cam switch is switched off without outputting pulses. At this time, the controller recognizes that a low signal is input from the cam switch. Accordingly, when the signal inputted from the cam switch is the low signal, the controller recognizes that the cam switch is in the switch-off state.

The controller determines whether a predetermined first time has elapsed from when the pulse signal is not input from the cam switch, that is, when the low signal is input (S2040). In detail, the controller measures the time from the time when the low signal is input, and determines whether the measured time exceeds the first time. Thus, the controller determines whether the cam switch is in the switch-off state. If the pulse is input again within the first time, the controller re-measures the time from the time when a low signal is input again. At this time, the first time may be set to one second or less. For example, the first time may be set to 100 ms.

After the first time has elapsed without the pulse input, the controller determines whether a predetermined second time has elapsed (S2050). In detail, when the time measured from the time when the low signal is input exceeds the first time, the controller measures the time again from the time when the first time elapses, and determines whether the predetermined second time elapses. At this time, the second time may be set differently depending on the frequency of the AC power to five seconds or less. For example, when the frequency of the AC power is 60 Hz, the second time may be set to 3.5 seconds. When the frequency of the AC power is 50 Hz, the second time may be set to 4.22 seconds.

When the cam switch is switched off, the clutch unit is switched to the first mode. Accordingly, the coupling of the clutch unit moves downward, so that the lower gear portion is engaged with the power transmission gear of the rotor. Therefore, since the rotational force of the rotor is transmitted to the dewatering shaft through the coupling, the rotational force of the rotor is transmitted to both the washing shaft and the dewatering shaft, so that the dewatering mode in which the pulsator and the dewatering tub rotate together is performed.

When it is determined that the cam switch is turned off, the controller stops the clutch motor (S2060). At this time, since the clutch unit is located at the first mode by the clutch motor, the washing machine performs the dewatering mode.

As described above, the controller may determine whether the input low signal is due to noise by measuring the elapsed time after the input of the low signal outputted from the cam switch, thereby preventing the washing machine from malfunctioning due to noise.

While the embodiments of the present disclosure have been described, additional variations and modifications of the embodiments may occur to those skilled in the art once they learn of the basic inventive concepts. Therefore, it is intended that the appended claims shall be construed to include both the above embodiments and all such variations and modifications that fall within the spirit and scope of the inventive concepts.

What is claimed is:

1. A washing machine comprising:

a main body;

a washing tub provided inside the main body to receive washing water;

a dewatering tub rotatably provided inside the washing tub;

a driving device configured to supply a rotational force;

a clutch unit provided to operate in a first mode in which the rotational force generated in the driving device is transmitted to the dewatering tub and a second mode in which the rotational force generated in the driving device is not transmitted to the dewatering tub;

a clutch motor to switch an operation mode of the clutch unit; and a cam switch switched from a switch-off state to a switch-on state as the clutch motor rotates, wherein the cam switch outputs pulses having the same period as a frequency of an alternative current power supplied to the clutch motor in the switch-on state, and wherein the clutch unit and the cam switch are arranged so that at a time when the cam switch is switched from the switch-off state to the switch-on state, the clutch motor is stopped and the clutch unit does not transmit the rotational force of the driving device to the dewatering tub.

2. The washing machine of claim 1, wherein when the cam switch is switched from the switch-on state to the switch-off state, the clutch unit is stopped.

3. The washing machine of claim 1, further comprising:

a pulsator rotatably provided in a bottom of the dewatering tub, wherein when the clutch unit operates in the first mode, the dewatering tub and the pulsator rotate together, and when the clutch unit operates in the second mode, the pulsator rotates.

4. The washing machine of claim 1, wherein the clutch unit comprises, a coupling to be separated from the driving device when the coupling moves upward from a position coupled to the driving device;

a rotating member to be pivotally rotated to lift the coupling; and a link member to be reciprocatingly moved by receiving a rotational force of the clutch motor and to pivotally rotate the rotating member.

5. The washing machine of claim 4, wherein when the coupling is coupled to the driving device, the clutch unit operates in the first mode, and when the coupling is separated from the driving device, the clutch unit operates in the second mode.

6. The washing machine of claim 1, wherein the cam switch comprises, a cam to receive a rotational force from the clutch motor;

a moving contact in contact with a side surface of the cam; and a stationary contact in contact with or separated from the moving contact, and wherein when the moving contact is in contact with the stationary contact, the cam switch is in the switch-on state, and when the moving contact is separated from the stationary contact, the cam switch is in the switch-off state.

7. The washing machine of claim 6, wherein the cam includes a pressing portion, a releasing portion having a smaller radius than that of the pressing portion, and a connecting portion connecting the pressing portion and the releasing portion, and wherein when the moving contact is in contact with a side surface of the pressing portion, the moving contact is in contact with the stationary contact, and when the moving contact is in contact with a side surface of the releasing portion, the moving contact is separated from the stationary contact.

8. The washing machine of claim 6, wherein the cam switch includes, a switch terminal electrically connected to the moving contact; and a power terminal electrically connected to the stationary contact, and wherein the power terminal is connected to the alternative current power supplied to the clutch motor, and the pulses are output from the switch terminal when the cam switch is switched on.

9. The washing machine of claim 1, further comprising:

a controller configured to count a number of the pulses output from the cam switch.

* * * * *